US007135083B2

(12) United States Patent
Middelstadt et al.

(10) Patent No.: US 7,135,083 B2
(45) Date of Patent: Nov. 14, 2006

(54) WEB MATERIAL ADVANCE SYSTEM FOR WEB MATERIAL APPLICATOR

(75) Inventors: Scott K. Middelstadt, Vancouver, WA (US); James N. Hartman, Parma, ID (US); Peter M. Downie, Vancouver, WA (US)

(73) Assignee: Adalis Corporation, Vancouver, WA (US)

( * ) Notice: Subject to any disclaimer, the term of this patent is extended or adjusted under 35 U.S.C. 154(b) by 0 days.

(21) Appl. No.: 10/415,780

(22) PCT Filed: Oct. 30, 2001

(86) PCT No.: PCT/US01/45596

§ 371 (c)(1),
(2), (4) Date: Dec. 1, 2003

(87) PCT Pub. No.: WO02/39219

PCT Pub. Date: May 16, 2002

(65) Prior Publication Data

US 2004/0094263 A1 May 20, 2004

(51) Int. Cl.
*B65H 21/00* (2006.01)

(52) U.S. Cl. ..... 156/157; 156/73.4; 156/264; 156/353; 156/358; 156/363; 156/505; 156/506; 156/511; 156/519; 493/86; 493/378; 242/555.3; 242/556; 242/556.1; 242/555.4

(58) Field of Classification Search ..... 156/504, 156/505, 506, 511, 519, 521, 157, 264, 265, 156/270, 302, 73.4, 353, 358, 363; 493/86, 493/378; 242/555.3, 556, 556.1, 555.4
See application file for complete search history.

(56) References Cited

U.S. PATENT DOCUMENTS

| | | | | |
|---|---|---|---|---|
| 2,987,108 | A | 6/1961 | Kilmartin | |
| 3,075,718 | A | 1/1963 | Butler, Jr. | |
| 3,580,757 | A | 5/1971 | Niepmann | |
| 3,618,483 | A | 11/1971 | Helm | |
| 3,627,626 | A * | 12/1971 | Chao | 346/135.1 |
| 3,660,208 | A | 5/1972 | Hubbard | |
| 3,738,587 | A | 6/1973 | Cristiani | |
| 3,886,033 | A | 5/1975 | MacDonald et al. | |
| 3,894,905 | A | 7/1975 | Ehlscheid | |
| 3,896,820 | A * | 7/1975 | Ludszeweit et al. | 131/280 |
| 3,939,032 | A | 2/1976 | Taitel et al. | |
| 3,957,570 | A | 5/1976 | Helm | |
| 4,067,760 | A | 1/1978 | Nelson et al. | |
| 4,106,974 | A | 8/1978 | Hirsch | |
| 4,120,034 | A | 10/1978 | Fisk et al. | |
| 4,120,739 | A | 10/1978 | Peeters et al. | |
| 4,157,934 | A | 6/1979 | Ryan et al. | |
| 4,181,558 | A | 1/1980 | Neubronner | |

(Continued)

FOREIGN PATENT DOCUMENTS

DE 1250229 B 9/1967

(Continued)

*Primary Examiner*—Linda Gray
(74) *Attorney, Agent, or Firm*—Klarquist Sparkman, LLP

(57) ABSTRACT

An apparatus for feeding and cutting lengths of tape and advancing the lengths to a vacuum wheel applicator, the feed section of the apparatus comprising a feed roll, an anvil vacuum roll, and a rotary knife adjacent to the anvil vacuum roll, and means for adjusting the speed of the feed roll and the speed of the anvil vacuum roll to vary the length of the tape advanced to the applicator, and a tape roll splicing assembly to provide a continuous supply of tape to the apparatus.

20 Claims, 17 Drawing Sheets

U.S. PATENT DOCUMENTS

| | | | | | |
|---|---|---|---|---|---|
| 4,190,483 | A | | 2/1980 | Ryan et al. | |
| 4,332,635 | A | | 6/1982 | Holbrook et al. | |
| 4,364,787 | A | | 12/1982 | Radzins | |
| 4,405,066 | A | | 9/1983 | Roccaforte | |
| 4,450,039 | A | | 5/1984 | Salvucci et al. | |
| 4,455,190 | A | | 6/1984 | Bianchetto et al. | |
| 4,481,053 | A | | 11/1984 | Tokuno et al. | |
| 4,506,816 | A | | 3/1985 | Roccaforte | |
| 4,580,709 | A | | 4/1986 | Roccaforte | |
| 4,589,943 | A | | 5/1986 | Kimball et al. | |
| 4,643,783 | A | * | 2/1987 | Hogenson | 156/64 |
| 4,668,328 | A | | 5/1987 | Kyytsonen | |
| 4,720,320 | A | * | 1/1988 | Niemi | 156/504 |
| 4,722,489 | A | | 2/1988 | Wommer | |
| 4,795,510 | A | | 1/1989 | Wittrock et al. | |
| 4,917,327 | A | | 4/1990 | Asbury et al. | |
| 4,925,521 | A | | 5/1990 | Asbury et al. | |
| 5,021,111 | A | | 6/1991 | Swenson et al. | |
| 5,029,768 | A | | 7/1991 | Asbury et al. | |
| 5,064,488 | A | * | 11/1991 | Dickey | 156/159 |
| 5,078,311 | A | | 1/1992 | Taguchi et al. | |
| 5,224,405 | A | | 7/1993 | Pohjola | |
| 5,415,716 | A | | 5/1995 | Kendall | |
| 5,429,576 | A | | 7/1995 | Doderer-Winkler | |
| 5,501,763 | A | | 3/1996 | Ueda et al. | |
| 5,573,626 | A | | 11/1996 | Rossini et al. | |
| 5,624,526 | A | * | 4/1997 | Perecman et al. | 156/361 |
| 5,692,699 | A | | 12/1997 | Weirauch et al. | |
| 5,772,150 | A | | 6/1998 | Spatafora et al. | |
| 5,775,629 | A | | 7/1998 | Cyr | |
| 5,782,736 | A | | 7/1998 | Brizzi et al. | |
| 5,839,634 | A | | 11/1998 | Pollard et al. | |
| 5,913,991 | A | | 6/1999 | Kubota et al. | |
| 5,947,360 | A | | 9/1999 | Frank | |
| 6,007,660 | A | | 12/1999 | Forkert | |
| 6,013,148 | A | | 1/2000 | Bluemle | |
| 6,172,698 | B1 | | 1/2001 | Iwata et al. | |
| 6,173,876 | B1 | | 1/2001 | Sano et al. | |
| 6,475,325 | B1 | | 11/2002 | Parrish et al. | |
| 6,488,228 | B1 | | 12/2002 | Davies et al. | |
| 2002/0038686 | A1 | | 4/2002 | Parrish et al. | |
| 2002/0050324 | A1 | | 5/2002 | Middelstadt et al. | |
| 2002/0059982 | A1 | | 5/2002 | Hartman et al. | |
| 2002/0079042 | A1 | | 6/2002 | Hartman et al. | |
| 2002/0079045 | A1 | | 6/2002 | Parrish et al. | |

FOREIGN PATENT DOCUMENTS

| | | | |
|---|---|---|---|
| DE | 4209262 | | 1/1992 |
| EP | 0 776 848 | A2 | 11/1995 |
| EP | 0 691 267 | | 1/1996 |
| EP | 1 132 325 | | 9/2001 |
| GB | 2 143 802 | | 2/1985 |
| GB | 2 315 041 | | 1/1989 |
| JP | 08-309890 | | 11/1996 |
| WO | WO 96/35574 | | 11/1996 |
| WO | WO 00/15729 | | 3/2000 |
| WO | WO 02/39219 | | 5/2002 |

* cited by examiner

WEB MATERIAL ADVANCE SYSTEM FOR WEB MATERIAL APPLICATOR

This is a § 371 U.S. national stage of PCT/US01/45596, filed Oct. 30, 2001, which was published in English under PCT Article 21(2), and claims the benefit of U.S. application Ser. No. 09/703,968, filed Nov. 1, 2000, and U.S. application Ser. No. 09/843,005, filed Apr. 26, 2001.

BACKGROUND

The present invention relates to an improved web material dispenser for advancing a web material to an applicator, such as a tape applicator for applying a strip of tape to form a cutting edge, a reinforcing tape, a box sealer, and the like. The system utilizes splicing system for continually advancing tape to a feed roller which advances the web to a vacuum anvil roll where the web material is cut and advanced to a vacuum wheel applicator. In one aspect the invention relates to a web material delivery system capable of changing the length of the web material delivered to the applicator. The speed of the feed roll and the speed of the independently driven vacuum anvil roll and cutting roller are determined by a motor control and the position of the web material on the substrate is regulated by a programmable logic control and encoder set by an indicator triggered by the substrate. In another aspect the invention relates to a web material delivery system that provides web material continuously by splicing lengths of the web material to avoid interruption of the applicator operation.

The application of hot melt material to substrates to form laminates is not new. One such patent is U.S. Pat. No. 6,007,660 (Forkert). In this patent, the pinch rollers advance the lamina toward two sensors. The substrate is sensed by a third sensor. When the sensors for the lamina, either 88 or 90 sense the lamina, the feed for the lamina stops and a scissor is actuated. The substrate is driven along a path toward the laminating rollers. After the scissors are actuated, rollers are actuated to advance the substrate. To make sure the substrate is not fed along the path too soon, the substrate is sensed by a third sensor. When the substrate is sensed, the lamina is conveyed and both the lamina and substrate are fed between the laminating rollers. Conventional control mechanisms, i.e., a microprocessor, are used to respond to sensor signals, actuate the scissors, and engage and disengage the clutch-controlled elements of the drive-train. The stopping and starting of the lamina and substrate render such a mechanism uneconomical for a hot melt feeder and carton laminator, which typically operate at 600 to 1000 feet per minute (182 meters to 305 meters per minute).

U.S. Pat. No. 4,795,510 (Wittrock et al.) discloses applying patches of reinforcement material to a web. The patch material is coated with a hot melt adhesive and is advanced to a phasing means, such as vacuum anvil roll 54, which provides a selected spatial segregation between the individual patches, and assembling means, such as a stomper roll, which adhesively secures the segregated patches onto selected spaced regions of the moving web layer. Indexing means such as a pull-back roll, selectively displace the coated substrate material from the knife roll when an assembly feed roll is disengaged from the substrate material. The knife roll, which cuts the patch material after it is on the anvil vacuum roll, acts in response to an indexing means, such as pull-back roll, which selectively displaces the coated patch material from the knife roll when an assembly feed roll is disengaged from the patch material.

U.S. Pat. No. 4,917,327 (Asbury et al) discloses a splicing system for splicing the trailing end of one tape to the leading end of another. The first tape 12 is provided at its trailing end with a pin element 16. A second tape 18 is provided at its leading end with a loop element 22. When the pin engages the loop, the tapes become linked, causing the trailing end of the first tape to pull the leading end of the second tape into the machine. The patent family includes U.S. Pat. No. 5,029,768 and Canadian patent 1,280,097.

U.S. Pat. No. 5,692,699 (Weirauch et al.) discloses a tape with a splicing portion 1, 2 and an attachment portion 10", 41. The tape has an attachment portion 10", 41 for attaching the splicing portion 1, 2 and separating the splicing portion from the surface of the underlying layer. This patent is directed to a specific splicing tape for attaching the end of a roll of paper to an outer wrap on the roll.

U.S. Pat. No. 5,913,991 (Kubota et al.) discloses attaching a length of magnetic tape to a leader. The apparatus aligns ends of the tapes with the ends of the leaders extending from a cassette and splices the ends using vacuum holders for the ends.

U.S. Pat. No. 5,573,626 (Rossini et al) discloses a tape splicing machine that splices adhesive tape in a supply roll to the lead end of a subsequent roll. The tapes 24 and 26 are guided to the splicing station and between the splicing rollers 212, 252. When the supply tape nears the end and the microswitch is triggered to actuate the solenoid 230, the roller 212 is carried toward the roller 252 where the lead end of tape 44 is positioned to contact the supply tape 42. When the splice is made, the tape 42 makes contact with the tape 44 and the splice is made and the tape 42 is cut.

SUMMARY

In this application, the term "web" shall be referred to simply as "tape," but is intended to include various ribbon materials, various web materials, and various widths of material, particularly tapes with an adhesive including, for example, a hot melt pressure sensitive adhesive, a hot melt remoistenable adhesive, a water dispersible hot melt adhesive, a biodegradeable hot melt adhesive, a repulpable hot melt adhesive, and heat activatable adhesives. Examples of these adhesives are any typical hot melt adhesive such as an ethylene-vinyl acetate copolymer hot melt adhesive, ethylene methylacrylate-based hot melt adhesive, ethylene n-butyl acrylate-based hot melt adhesive, hot melt adhesive based on polyamides, hot melt repositionable adhesive based polyamides and copolyesters, hot melt adhesives based on polyethylene and polypropylene homopolymers, copolymers and interpolymers, rubbery block copolymer hot melt adhesives, and radio frequency ("RF") activatable adhesives.

The term "substrate" includes films, non-woven webs, paper products, paper board, carton blanks, box board, and other sheet materials and comparable webs, having various widths.

The illustrated embodiment of the invention described below is designed for use with a tape that includes a backing, for example, a paper product, and an adhesive compositon disposed on the backing.

The present invention is directed to a dispenser for a length of tape, comprising a tape feed section for advancing the tape along a predetermined path, a tape applicator section for accepting the tape and a substrate feed section for advancing the substrate past the applicator section. The tape feed section includes a feed roll and associated means for advancing tape from a supply, i.e. a pressure roll or increased frictional surface or a positive drive. It further includes a vacuum anvil roll for picking up the tape from the feed roll and a knife roll for cutting lengths of tape on the vacuum roll. Drive means rotate the vacuum anvil roll. The vacuum anvil roll has an outer foraminous cylindrical peripheral surface and means for applying subatmospheric pressure at said surface throughout a portion of the surface during each rotation thereof. Means support the vacuum roll for rotation about an axis perpendicular to the path of the web material. A cutting wheel (rotary knife roll) is positioned near the vacuum roll, for rotation with the vacuum roll, to engage the web material on the vacuum roll opposite a hardened insert, to cut the same to the desired length. An application means receives the cut length of web material and advances the cut length to a substrate. Changes in the length of web material can be made with this tape advancing section without mechanical changes to the basic components. The feed roll and the vacuum roll have separate drive means for affording rotation of the feed roll at a peripheral surface speed different from the peripheral speed of the surface of the vacuum roll. The speeds can be effectively adjusted by the use of a motor control and the positioning of a length of tape on the substrate is accomplished by a programmable logic controller so that the length of tape applied and the location of the tape on the substrate can be changed easily.

Further, application preparation means can be provided for treating the length of tape prior to and in preparation for application to the substrate.

A dispenser application means carries the length of tape to the substrate. The illustrated application means comprises a vacuum wheel applicator that picks up the length of tape and retains the same on a foraminous surface to carry the length of tape about an arcuate path to an area where it is transferred to the substrate.

The preparation means may be a heater placed about a portion of the arcuate path to heat the tape as it is advanced past the heater. Such preparation means are specifically adapted for use with the hot-melt coated tapes and serve to heat the adhesive to a softened plasticized state to adhere to the substrate. There is no stopping and starting of the lamina and substrate, which actions tend to render such a mechanism uneconomical for a hot melt feeder and carton laminator, which typically operate at 600 to 1000 feet per minute (182 meters to 305 meters per minute).

The splicing system affords the splicing of successive lengths of tape from supply rolls to provide a continuous length of tape to the applicator, and includes the definition of the proper web path from supply roll spindles to the splicing station. The splicing station utilizes a pair of cutting systems, staging members, splicing rolls and guide rollers defining a web path for the tape that extends from the splicing station to the applicator. The roll spindles, for placement of a supply roll and for a second supply roll of tape, and the rollers define the path of the tape. Pressure sensitive tape is placed in overlapping fashion on the free end of the second roll of tape and extends therepast for engaging the present supply of tape near the end thereof. The splicing tape is placed on the leading end of the tape from the second supply roll while on the staging plate. The staging plate is supported along the web path of the second roll of tape from either spindle and the path is defined by a series of rollers that act to reverse the memory in the tape in the wrapped condition in the supply roll. The rollers guide and direct the tape from the roll to a predetermined web path. The splice is controlled by the use of a splicing tape placed upon the leading end of the second roll and is placed together with the free end of the second supply roll at the staging area and splicing junction. The splice is triggered by the actuation of power to operate the splicing rolls and the appropriate cutting knife to complete the splice. The power to trigger the splicing rollers, the staging area and knives can be generated from controls actuated in response to the tape position and by the splice completion and timer. Manual controls, as illustrated, actuate the elements by pneumatic power, and manual operation positions the splicing tape on the free end of the supply tape and places the splicing tape in the nip rollers that make the initial splice. Sensors can be employed to activate the splicing sequence and a programmable logic controller (PLC) can be used to interface with the pneumatic system.

The knives are positioned upstream from the staging area and move in a transverse direction in relation to the web path from a standby position to a cutting position in alignment with the supply web. The knives are preferably at a reverse angle to cut the tape. They are also positioned between guard blocks to avoid injury. Actuation of the knives is handled by pneumatic cylinders triggered by pneumatic control valves for directing stored energy to the elements.

The method of the present invention affords the continuous delivery of an adhesive tape to an applicator or a dispensing means. The first step includes cracking the memory of the web from its curled condition to a straight line and reverse curve. Secondly, the second supply roll receives a length of splicing tape that includes a film backing and a coating of pressure sensitive adhesive disposed on the film backing. The second roll receives the splicing tape in such a manner that it extends beyond the end of the second roll to engage the supply web with the adhesive coated side of the splicing tape directed inwardly of the two webs. The splicing tape is then joined to the supply web by pinching the free end of the splicing tape to the adjacent surface of the supply web. The supply web is then cut so the splicing tape and second tape advance toward the applicator for applying the adhesive coated tape to an article.

BRIEF DESCRIPTION OF THE DRAWINGS

The present invention will be described with reference to the accompanying drawing of a preferred embodiment wherein.

DETAILED DESCRIPTION

Figure 1:
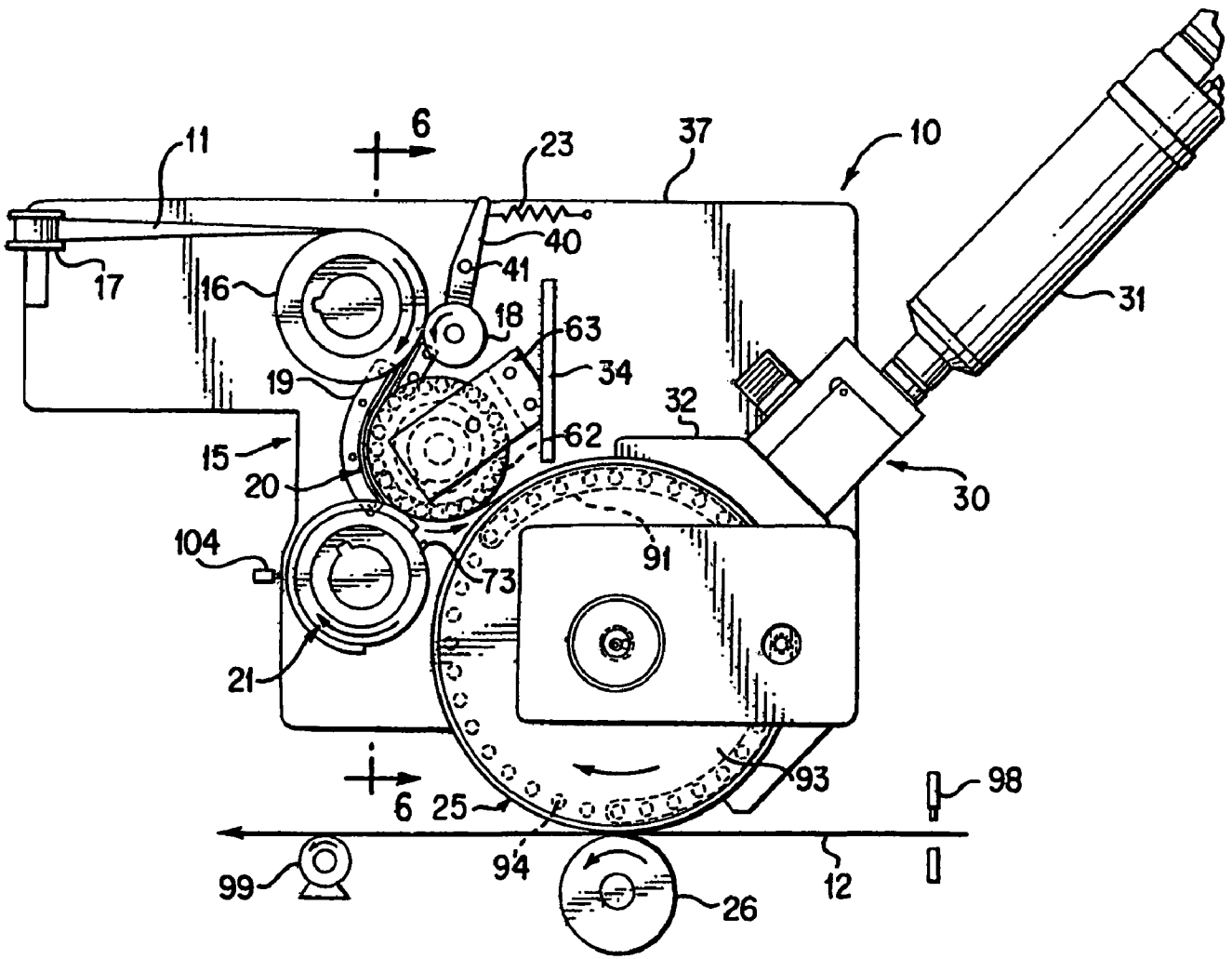
FIG. 1 is a diagrammatic fragmentary elevational view illustrating the features of the tape advancing mechanism and a dispenser according to this invention.
Figure 2:
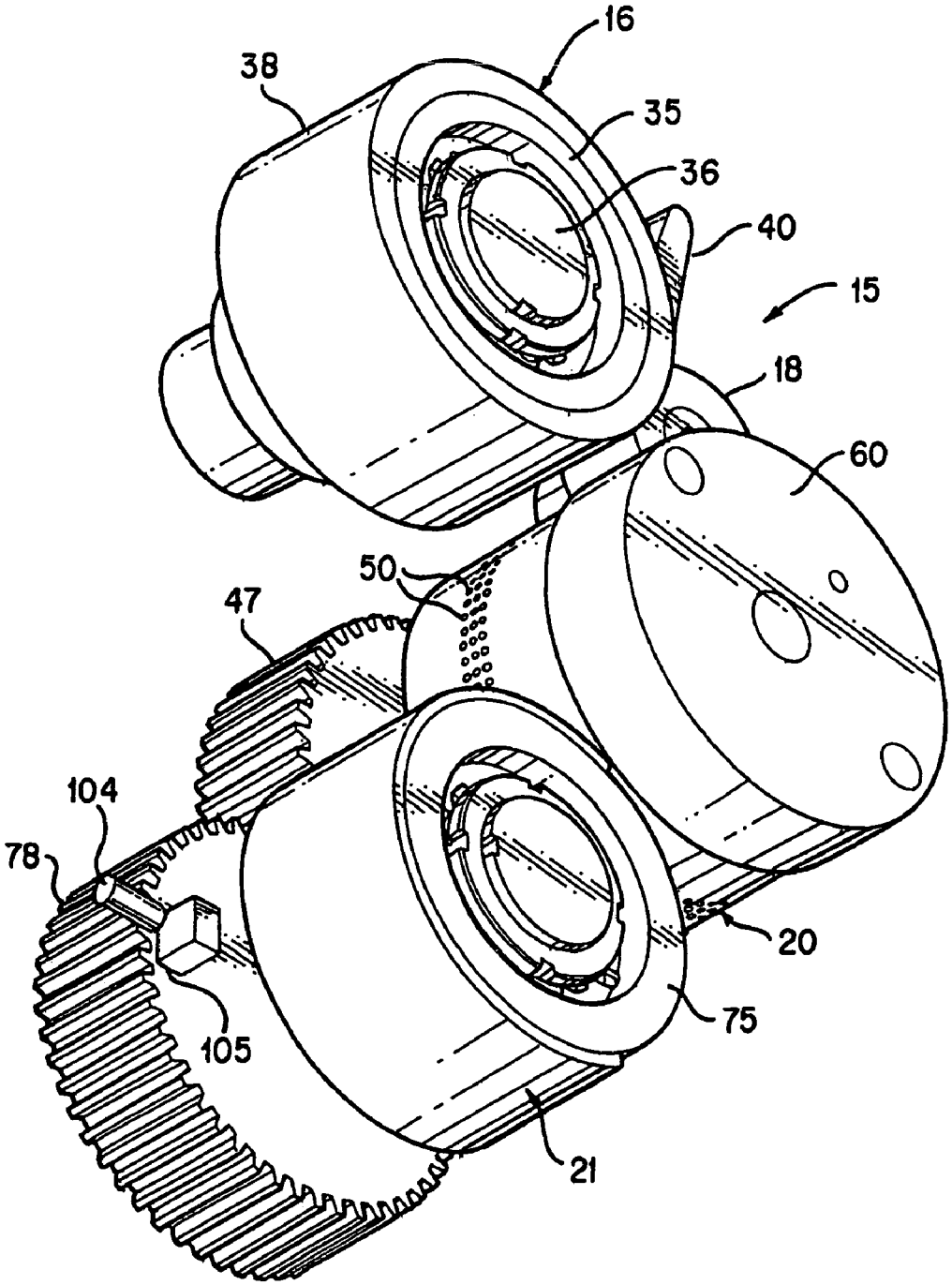
FIG. 2 is a perspective view of the feed section of the dispenser as viewed from the front lower left side as shown in FIG. 1.
Figure 3:
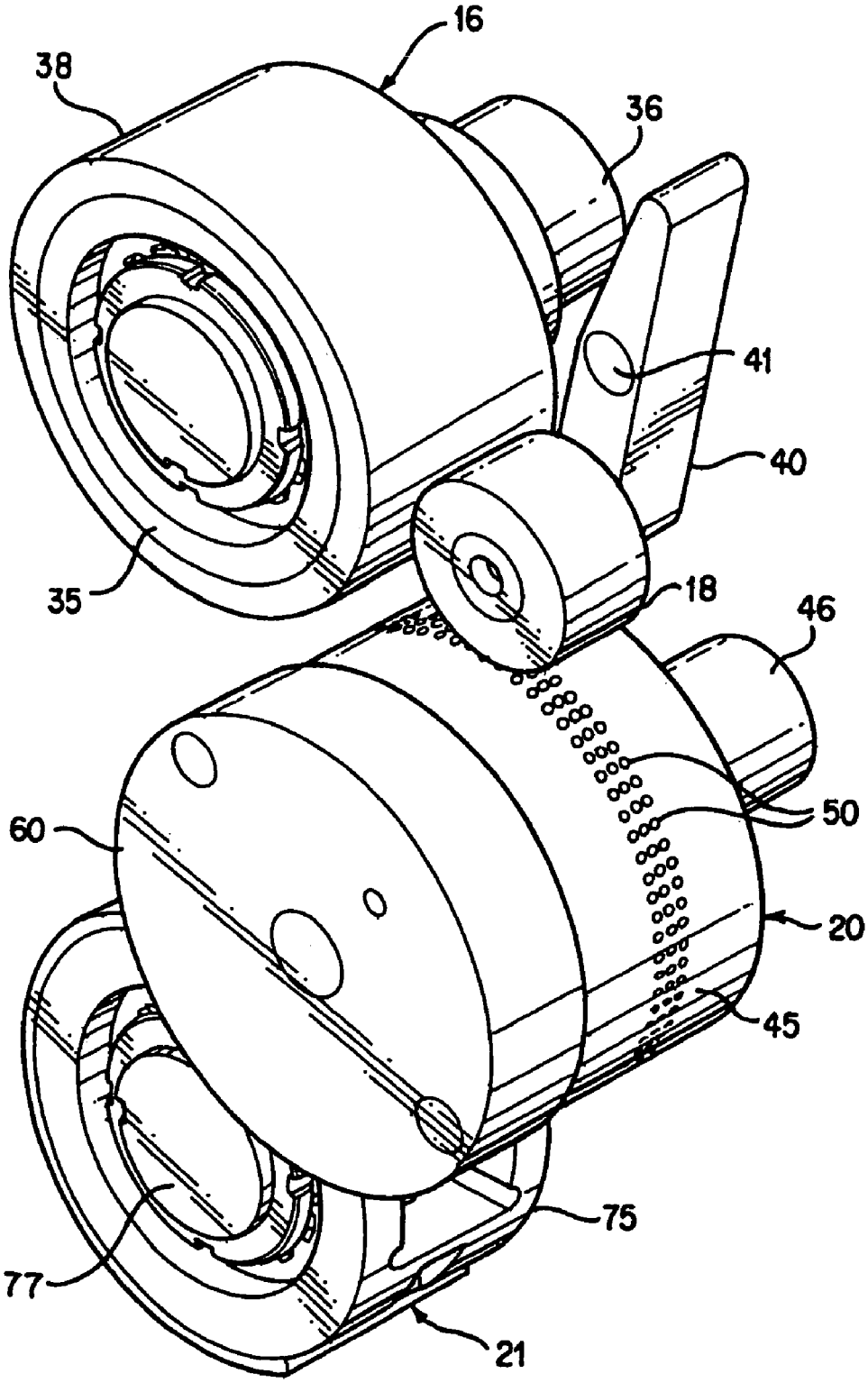
FIG. 3 is a perspective view of the feed section of the dispenser as viewed from the front upper right side.

This invention relates to a machine for handling a tape and is capable of applying different lengths of tape to a moving substrate and placing the cut length of tape in a desired position. In real time this means applying the tape to substrates such as cartons at predetermined locations on the substrate, so as to provide a cutting edge tape as described in copending U.S. application Ser. No. 09/154,005 filed Sep. 16, 1998, and assigned to the assignee of this application, and to a web of carton material to reinforce the carton material, to form a reinforced handle or a combination thereof. The application speed can be approximately 1000 feet per minute (305 meters per minute). An example of cutting edge tape is a film tape coated with adhesive for application to the carton board of a carton for a convolutely wound roll of sheeting in which the tape serves as the cutting edge on the carton for the sheet. The tape is formed of a polymeric film material in a continuous strip, which is sufficiently stiff such that when it is applied to the free edge of a carton it provides the cutting function. The tape is applied to carton material in the carton manufacturing process as the carton material moves through the carton forming machine in the machine direction. The tape is applied at one station in the process where the adhesive coated surface of the tape is laminated against the carton board and is then cut to form a cutting edge along the edge of the front panel or the closing flap on the lid of the carton. The tape may be cut to form a straight edge or a serrated edge. Alternatively, the tape is cut to form serrations along one edge during the manufacture of the rolls of tape. The application of the cutting edge tape takes place at one station and after a predetermined amount of tape is dispensed, registered and laminated to the carton board adjacent the edge of the carton board forming the free upper edge of the front panel, it is cut from the roll. In either process, a continuous supply of tape is desired. This is described in detail below.

The advantage of a rotary knife and vacuum anvil roll according to the present invention is that a variety of lengths can be cut. Tape length changes can be made through a motor control and a programmable logic controller (PLC), which aid in the placement of the cut length in a precise position. This eliminates having to change out any mechanical parts to make the length changes. However, each piece of tape must get transferred from the rotary knife/vacuum anvil roll onto the vacuum wheel applicator. For each rotation of the rotary knife/vacuum anvil roll, the tape gets cut. The leading edge of the yet uncut tape must get directed onto the vacuum wheel applicator before the trailing edge can get cut. One discharge means, or one method of directing the tape onto the applicator is to place a web director/deflector to skive and direct the tape onto the vacuum wheel applicator. Another method is to place an air jet at the point where the tape is to transfer to direct the web material off the vacuum anvil roll toward the applicator. A third method or discharge means is to incorporate vacuum on the anvil roll. Vacuum, i.e. subatmospheric pressure, applied to a portion of the periphery of the anvil roll causes the leading edge of the tape to remain held against a portion of the periphery of the anvil roll as the anvil roll rotates, until the vacuum portion ceases and a blowoff port is encountered.

The idea of the vacuum anvil roll is to hold the leading edge of each piece of tape on the anvil roll until it can be transferred onto the vacuum wheel. To transfer the tape onto the vacuum wheel, the vacuum section on the anvil roll ends, followed immediately by a blow off port or jet of air under the free end of the tape to form discharge means on the anvil roll to move the tape end onto the vacuum wheel applicator. Thus, as the vacuum anvil roll rotates, the leading edge of the tape advances past the end of the vacuum created section and encounters the blow off port. The leading edge of the tape is now no longer under the control of the vacuum anvil roll. The blow off force, gravity and subatmospheric pressure, or vacuum at the surface of the vacuum wheel applicator, cause the leading edge of the tape to leave the anvil roll and to fall against the vacuum wheel applicator. As the vacuum wheel rotates, it continues to pick up more and more of the length of tape until the rotary knife makes the cut against the vacuum anvil roll. The trailing end of the cut piece continues to be held by the vacuum anvil roll, until that portion of the tape and the peripheral surface of the vacuum anvil roll rotates past the blow off port. At this point, the entire piece of tape gets transferred onto the vacuum wheel applicator. The vacuum anvil roll holds the leading edge of the next piece of tape until it too is transferred onto the vacuum applicator wheel.

In the following description, the reference numerals refer to like parts throughout the several views of the drawing. The present invention provides an improved dispensing and applicating apparatus 10 for advancing lengths of tape 11 that will be applied to a substrate 12. The substrate may be a carton blank or continuous board, i.e. 26 point paper board, but adding the reinforcing tape can make 22 and 24 point board useful. The length of tape applied to a carton blank, not shown, can extend the full length of the carton blank or can be applied to a portion of the carton length and at a pitch ratio related to the length of the carton blank or web and the position of the length of tape to the carton. The present applicator 10 is described for use with a vacuum wheel applicator 25, which takes the tape 11 advanced to it and applies the cut length to a given area on the carton blank. This places the tape in an area where the blanks are to be cut, forming a cutting edge, or alternatively, generally near a midpoint along the length of a carton blank, for example. The tape is generally an adhesive tape that includes a backing of between 2 mils (0.01 mm) to about 7 mils (0.18 mm) in thickness, for example of a polymeric film including, for example, polyester, polypropylene and polyethylene. The tape and the substrate can then be cut along the center of the tape to form a serated cutting edge for cartons used to dispense sheeting including, for example, films, paper, and metal wrapping foil.

The tape placed near the midpoint may also be a reinforcing tape and will then be in a position to reinforce a carrying handle, for example, on the finished carton. The carton may vary in size and thus it is important that the machine be capable of varying the tape lengths repeatedly dispensed when the carton length changes, as from a carton for a twelve pack, an eighteen, a twenty-four or for a thirty can carton, or when the pitch length between the middle of one carton size in one run varies from the pitch length of a second carton size.

The applicator 10 includes a feed section, generally designated 15, which advances tape 11 from a supply and places a cut length of tape of a desired length on an applicating wheel 25. This applicator vacuum wheel 25 advances the cut lengths of tape 11 to a substrate 12. Further, the illustrated apparatus 10 comprises a tape preparation system 30 for treating the tape for application to the substrate 12. In the illustrated example the preparation system is a heater that includes an air heater 31 and heat directing shroud 32 positioned about an arcuate portion of the vacuum wheel applicator 25. The tape section is transferred to the substrate from the surface of the vacuum wheel applicator 25 as the substrate and tape length pass between the vacuum wheel 25 and a backup roller 26. The use of the air heater 31 produces excess hot air that flows past the shroud 32. Because the tape 11 has the adhesive coated surface adjacent the surface of the vacuum anvil roll 20, an insulative wall 34 is supported by a frame 37 and is positioned between the shroud 32 and the vacuum anvil roll 20 to restrict the heating of the roll 20. The heat shield 34 is a mica based sheet of micarta.

The preparation means may alternatively include a coating system to coat an adhesive to the tape on the applicator 25. Also, a web of adhesive could be transfered from a liner to the tape.

The substrate feed section includes rollers and or belts, as known in the art, to move the substrate toward the nip area, and cooperating sensors 98 and a line speed encoder 99 cooperate with the electronic controls for the placing of the cut length of tape precisely on the carton or carton web.

The feed section 15 comprises a feed roll 16. The non-adhesive side of the tape is directed toward the surface of the feed roll 16. The feed roll 16 cooperates with a pressure roller 18, for advancing the tape 11 from a supply thereof over an idler pulley 17 and around the feed roll 16. The tape 11 contacts about 180 degrees of the feed roll 16. The tape is then threaded between two guides 19 defining a path to the vacuum anvil roll 20, about which it is carried to a transfer area and onto the vacuum wheel applicator 25. A rotary knife roll 21, supported for rotation on an axis parallel to the axes of the feed roll 16 and the vacuum anvil roll 20 cuts the tape 11 to the desired repeatable lengths when the relative speeds of the feed roll 16 and anvil roll 20 are set. The speeds of the periphery of the feed roll 16, the vacuum anvil roll 20 and the rotary knife 21, are changeable to change the length of tape applied to the applicator wheel 25 as the production order is changed.

Figure 6:
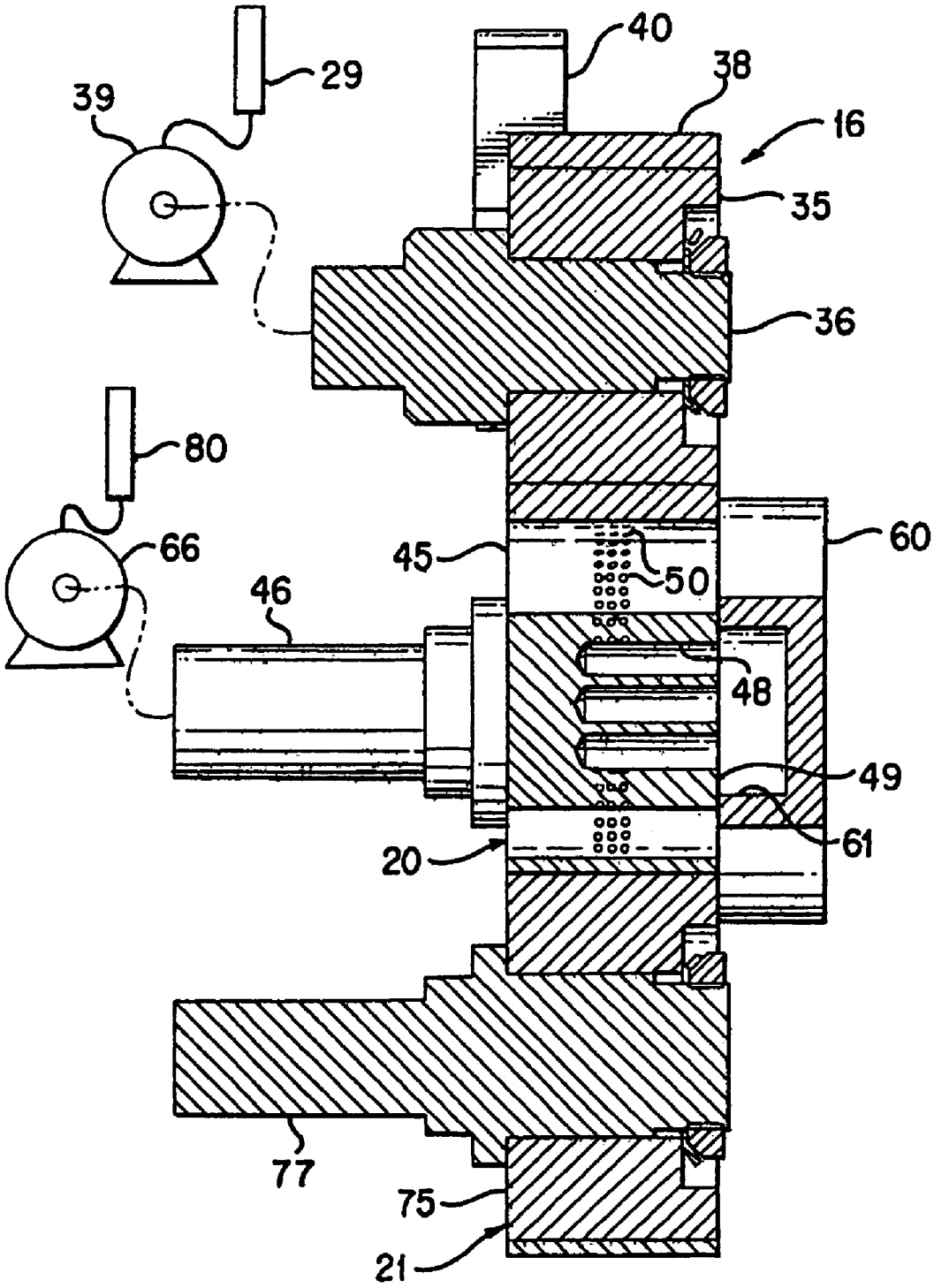
FIG. 6 is a vertical sectional view of the feed roll, the vacuum anvil roll and knife roll, as seen along line 6—6 of FIG. 1, and diagrammatically showing the drive motors and controls.
Figure 7:
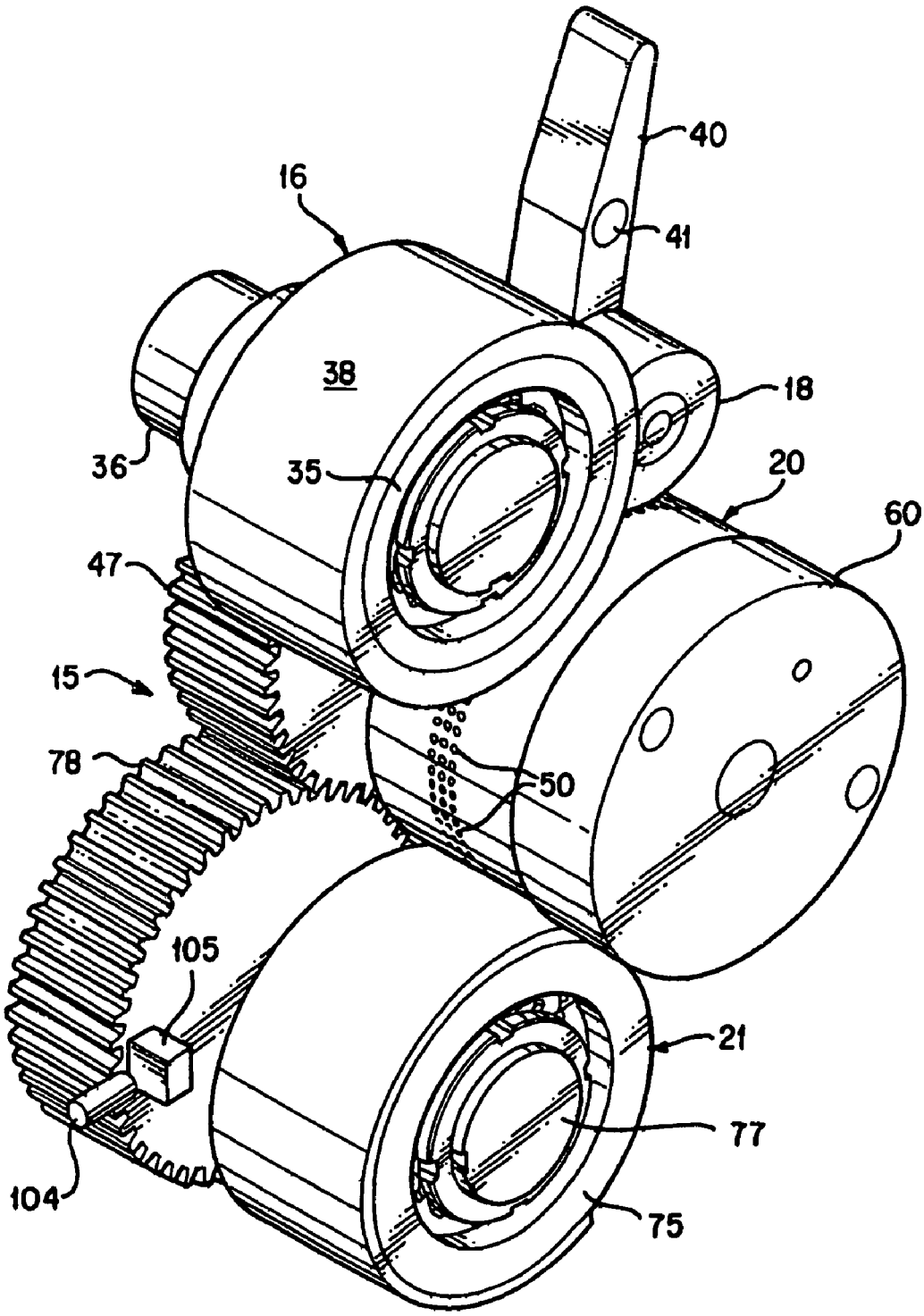
FIG. 7 is a front right perspective view of the feed section showing the drive gears for the vacuum anvil roll and knife roll and the knife sensor.
Figure 8:
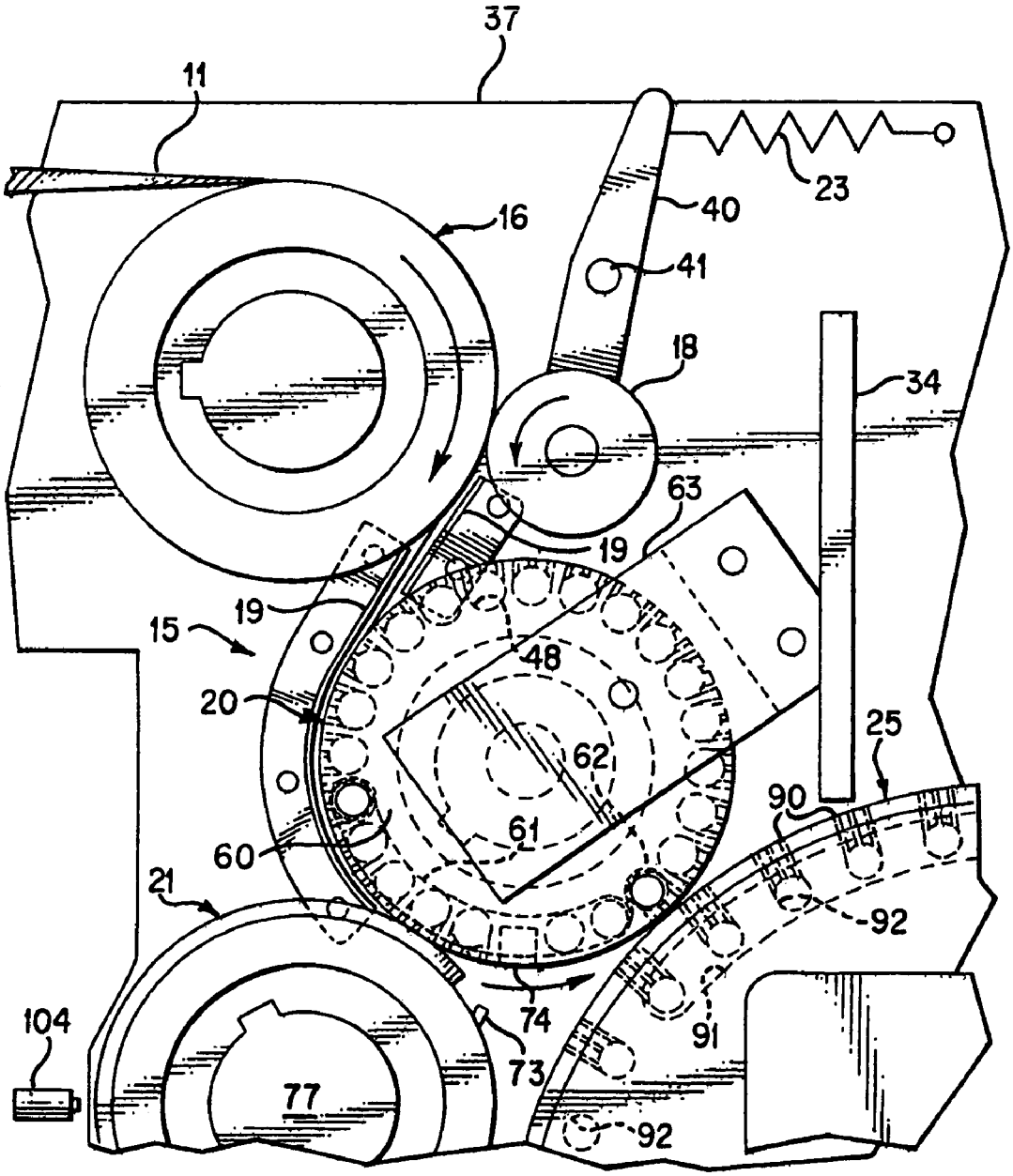
FIG. 8 is an enlarged fragmentary detail view of the feed roll, pressure roller, vacuum anvil roll and knife roll relationship.

The feed roll 16 comprises a hub 35 fixed to a shaft 36 and rotatably supported on the frame 37. The hub 35 has a tire 38 formed thereon, which is a material having a coefficient of friction of about 0.7 to aid in advancing the tape 11. The hub 35 is held on the shaft 36 by a threaded nut held in place by the tabs on a washer positioned against the hub and keyed to the shaft 36. A first motor 39, a DC motor operated through a DC motor controller 29, drives the feed roll 16, see FIG. 6. The pressure roller 18 holds the tape against the feed roll 16. The pressure roller 18 is rotatably mounted on a lever 40 by a stub shaft and the lever 40 is pivoted on a pin 41 to move the pressure roller 18 into engagement with the tape 11 to hold it against the feed roll 16. The lever 40 may be biased by a spring, torsion or tension, as illustrated by a tension spring at 23, to urge the roll 18 toward engagement with the feed roll 16. Alternatively, the web material may be driven by a sprocket on the feed roll.

Figure 5:
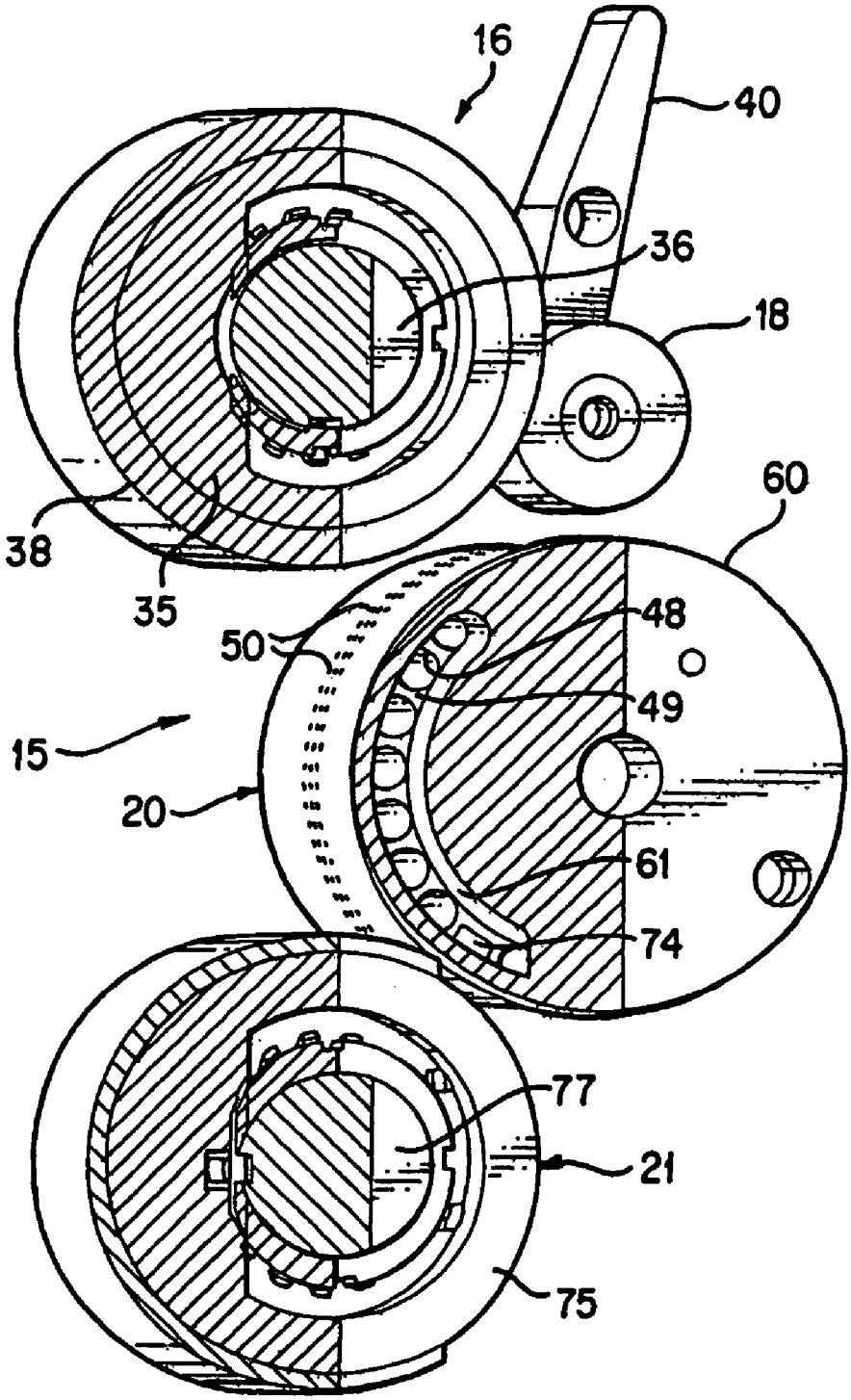
FIG. 5 is a perspective view of the feed section with parts in partial section to illustrate the structure of the various parts.

The vacuum anvil roll 20 comprises a hub 45 mounted on a shaft 46. The hub is formed of cold rolled steel and coated with IMPREGLON #420, a non-stick industrial surface coating available from the DuPont Company (Wilmington, Del.) under the trade designation 420-104. The adhesive surface of the tape 11 contacts about 180 degrees of the surface of the vacuum anvil roll 20, preferably between 160 to 200 degrees of the surface of the vacuum anvil roll 20. The anvil roll 20 has a plurality of axially extending holes 48 formed in one end wall 49 of the hub 45. The holes 48 are positioned near the periphery of the roll and are spaced circumferentially to communicate with axial rows of holes 50, in the surface of the roll 20, extending radially into the hub 45 from the peripheral surface. The holes 50 form a foraminous surface about the peripheral surface and near the axial midpoint of the external surface of roll 20. Each row of holes 50 communicates with one of the holes 48 formed in an end wall 49 of the hub 45. In this manner, the holes 50 are subjected to the same pressures as the holes 48. A manifold 60 is mounted against the end wall 49 of the hub 45. The manifold 60 has a grooved arcuate slot 61 extending about 90 to 180 degrees about its end wall adjacent axially to the end wall 49 of the hub 45, see FIGS. 1 and 5. The manifold 60 is supported in a fixed position by a bracket 63, and the slot 61 is positioned adjacent the path where the tape will engage the surface of the roll 20. The manifold 60 is also formed with a single axially extending bore 62 adjacent one end of the slot 61. This bore 62 is located in the manifold at the transition area where the leading end of the tape 11 is transferred from the vacuum anvil roll 20 to the vacuum wheel applicator 25. The slot 61 of the manifold is connected via openings in the manifold to a pump (not shown), which exhausts air from the slot 61. As the hub 45 of the vacuum roll 20 rotates, the holes 48 serially come into communication with the slot 61 and the air is exhausted from the holes 48 and from the holes 50 creating a force, which is less than atmospheric, a vacuum, against one side of the tape 11, and thus the atmospheric pressure holds the tape against the foraminous surface of the roll 20 in the area of the slot 61 as it rotates the holes 48 along the slot 61. Likewise, when a hole 48 moves past the slot 61 it is aligned axially with the bore 62, and that hole 48 is subjected to pressurized air, above atmospheric, and the air passes through the holes 48 progressively as the vacuum roll 20 is rotated past the transition area and the tape is lifted from the surface of the roll 20 and picked up by the surface of the vacuum wheel applicator 25. Air couplings are joined to the outboard side of the manifold 60 permitting air to be exhausted from the slot 61 and air to be forced under pressure into the bore 62. An air line of 0.25 inch (0.635 cm) diameter provided adequate air to blow the tape off the anvil roll 20. It will be readily understood that as the vacuum roll 20 rotates, the holes 48 become aligned with the slot 61 and the holes 50 draw the tape 11 against the surface of the vacuum roll 20. This moves the tape along with the rotation of the anvil vacuum roll. When the holes 48 become aligned with the bore 62 air is forced radially outward through a row of the holes 50 against the tape 11 pushing it off the surface of the roll 20, forming the discharge means for the tape. During the continued rotation, the holes 48 are covered by the adjacent end wall of the manifold 60. The pressure holding the tape on the surface of the roll 20 over the holes 50 is not such that the roll 20 cannot move faster than the tape 11, allowing slippage of the tape 11 on the roll 20, which tape is held at a given speed by the feed roll 16.

The vacuum anvil roll 20, having a hub 45, is driven by a shaft 46. Shaft 46 is driven by a second motor 66, such as a servomotor. The motor 66 drives shaft 46 and spur gear 47, which in turn meshes with a second spur gear 78. The spur gear 78 is supported on a rotatable shaft 77, to drive that shaft and the knife roll 21. The servomotor 66 is controlled by a servomotor control 80.

Figure 4:
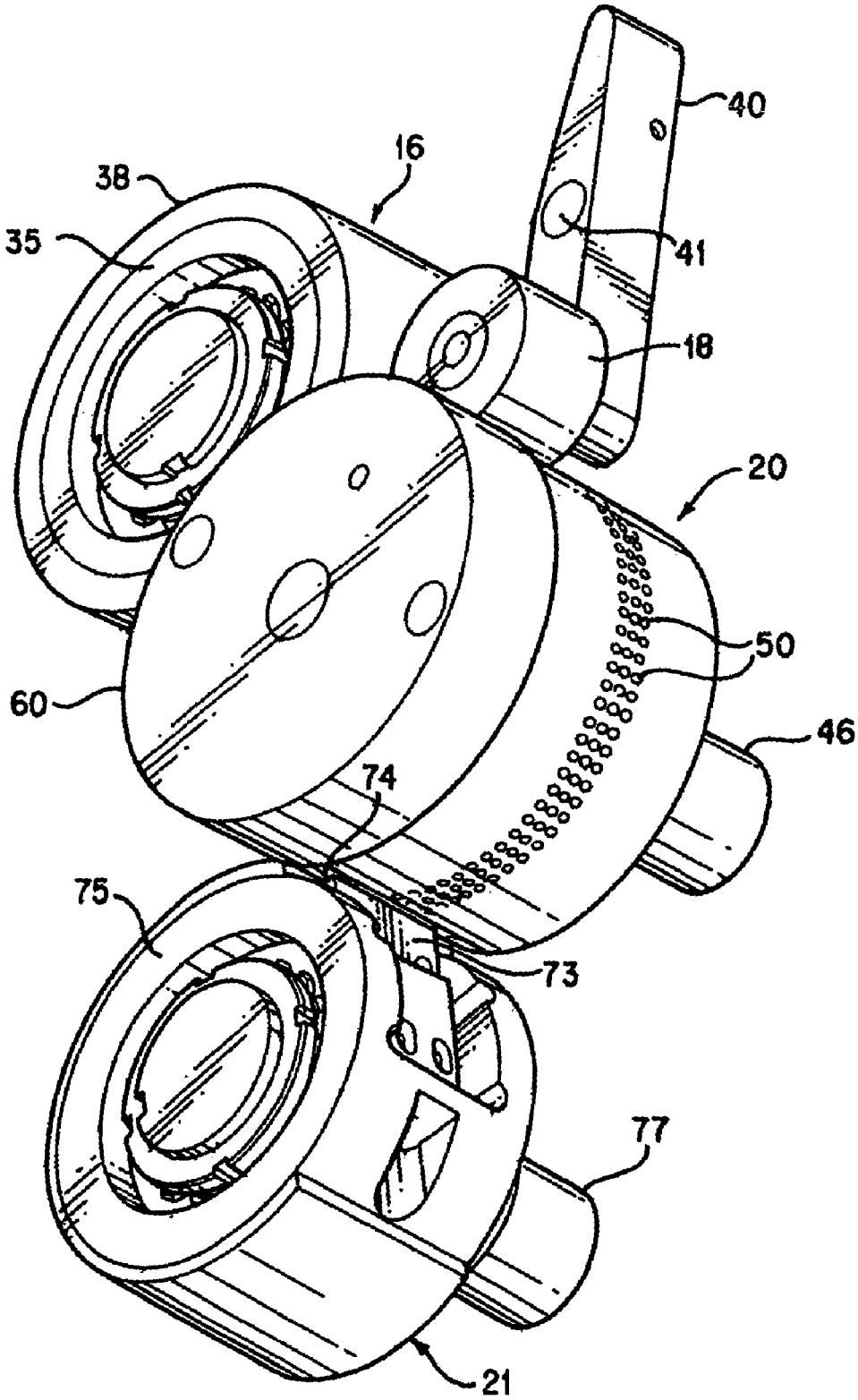
FIG. 4 is a perspective view of the feed section similar to FIG. 3, with the parts rotated to show the knife roll in greater detail.

The vacuum anvil roll 20 is formed to support the tape for cutting into lengths. This cutting is accomplished by a knife blade 73 mounted in the hub 75 of the rotary knife 21 and a hardened insert 74, placed in the peripheral surface of the vacuum anvil roll 20, see FIGS. 4 and 5. The blade 73 is a rectangular blade of steel having essentially four cutting edges. The edges forming the ends of the blade are the cutting edges. When placed in the hub 75, as shown in FIG. 4, an edge extends beyond the periphery of the hub to interfere with the vacuum anvil roller 20 and affect a crush cut of the tape 11 between the hardened anvil insert 74 and an edge of the blade 73.

The rotary knife 21 has the hub 75 mounted on a shaft 77 that is driven by the motor 66 and drive gears 47 and 78 to the shaft 46 of the vacuum anvil roll 20. The roll 20 and knife 21 are driven at the same speed and each time the blade 73 makes contact with the vacuum roll 20 it occurs at the location of the insert 74. The servomotor control 80 for the motor 66 and the DC motor controller 29 can change the relationship of the speeds of the feed roll 16 to the peripheral speed of the vacuum anvil roll 20. When the speeds are the same, the length of tape fed to the applicator 25 is equal to the peripheral length of one revolution of the vacuum anvil roller 20. As the speed of the vacuum anvil roll 20 increases with respect to the peripheral speed of the feed roll 16, the lengths of tape get shorter. Thus the motor control can adjust the relative peripheral speeds but the speed of the vacuum anvil roll and rotary knife is always equal to or greater than the speed of the feed roll 16.

The vacuum wheel applicator 25 is also provided with a foraminous surface formed by a series of holes 90 in axial extending rows connecting with axial holes 92 in the side wall of the wheel. These holes 92 are positioned about the end wall near the periphery, and, during rotation or the wheel, communicate with a groove 91 in a manifold 93. The groove or slot 91 extends about 270 degrees about the circumference of the wheel 25 to carry the cut length of tape from the transfer area near the air jet 62, to the area of transfer to the substrate 12 at the application area defined by backup roller 26.

The tape length placed upon the substrate, for example, carton blanks or continuous carton stock, is controlled by the PLC and DC motor controller 29 for the motor 39. The PLC and motor controller 29 receive line speed information from a line speed encoder 99 positioned along the substrate feed path and driven thereby. The peripheral speed of the vacuum wheel applicator 25 is matched to the line speed of the substrate. In cases where the tape length extends across the entire length of the carton, the PLC and motor controller 29 for motor 39, command motor 39 to rotate feed roll 16 and feed tape at a rate equal to the line speed as sensed by the line speed encoder 99. When beginning a production run of cartons requiring a tape length less than that of the carton length, the machine operator first inputs the length of tape information into the PLC and controller 29 for motor 39. For a tape length equal to one-half the carton length, motor 39 will rotate feed roll 16 at a rate equal to one-half of the line speed. Any one of a multitude of tape lengths can be cut and placed on the substrate. A specific tape length is dictated by a particular carton production job order. A machine operator simply imputs information into the PLC and motor controller 29 for motor 39 prior to the start of the tape application production run. Any one of a multitude of tape lengths can be cut and placed as dictated by a particular carton production job order without having to stop the production line application machinery for a time sufficient to change out mechanical parts.

Surprisingly, the applicator of the present invention is very versatile and can be adapted to apply a discrete piece of tape of any length, at any position on a substrate of any shape or size. The length of the tape can also be varied at will.

To position the length of tape properly on the substrate, an indicator 98, or sensor having cooperating elements, is positioned along the path of the substrate. The sensor 98 will detect the leading edge of a substrate or printed indicia on the substrate material, and send this information to the PLC and to the servomotor controller 80. The signal starts the count to the programmable logic controller (PLC), which determines the position of the length of tape in relationship to the edge of the substrate. The PLC and servomotor controller 80 and motor 66 use this information to control the rotational speed of the vacuum anvil roll 20 and knife roll 21 in order to effect a crush cut of the tape 11 between knife 73 and anvil insert 74. Exactly when the cut gets made, relative to the position of the moving substrate as the substrate moves towards the nip between vacuum wheel applicator 25 and backup roller 26, defines where the tape gets positioned properly on the substrate relative to the edge of the substrate. For each complete revolution of the vacuum anvil wheel 20 and knife roll 21, the tape gets positioned on the substrate relative to the edge of the substrate. For each complete revolution of the vacuum anvil roll 20 and knife roll 21, a knife sensor 104 and a sensor lug 105 that rotates with the hub 75 detects the rotational position of the knife roll 21. This signal information is used to update the PLC and servomotor controller 80 as to the exact position of the knife blade 73. This information is used by the PLC and servomotor comptroller 80 to continuously control the rotational speed of the vacuum anvil roll 20 and knife roll 21, in order for a crush cut of the tape 11 to occur at the correct position for each substrate.

When beginning a production run of cartons, a machine operator first inputs tape position information into the PLC and servomotor controller 80 prior to the start of the tape application production run. Any one of a multitude of tape positions relative to an edge or index mark can be placed as dictated by a particular carton production job order without having to stop the production line application machinery in order to change out mechanical parts.

Figure 9:
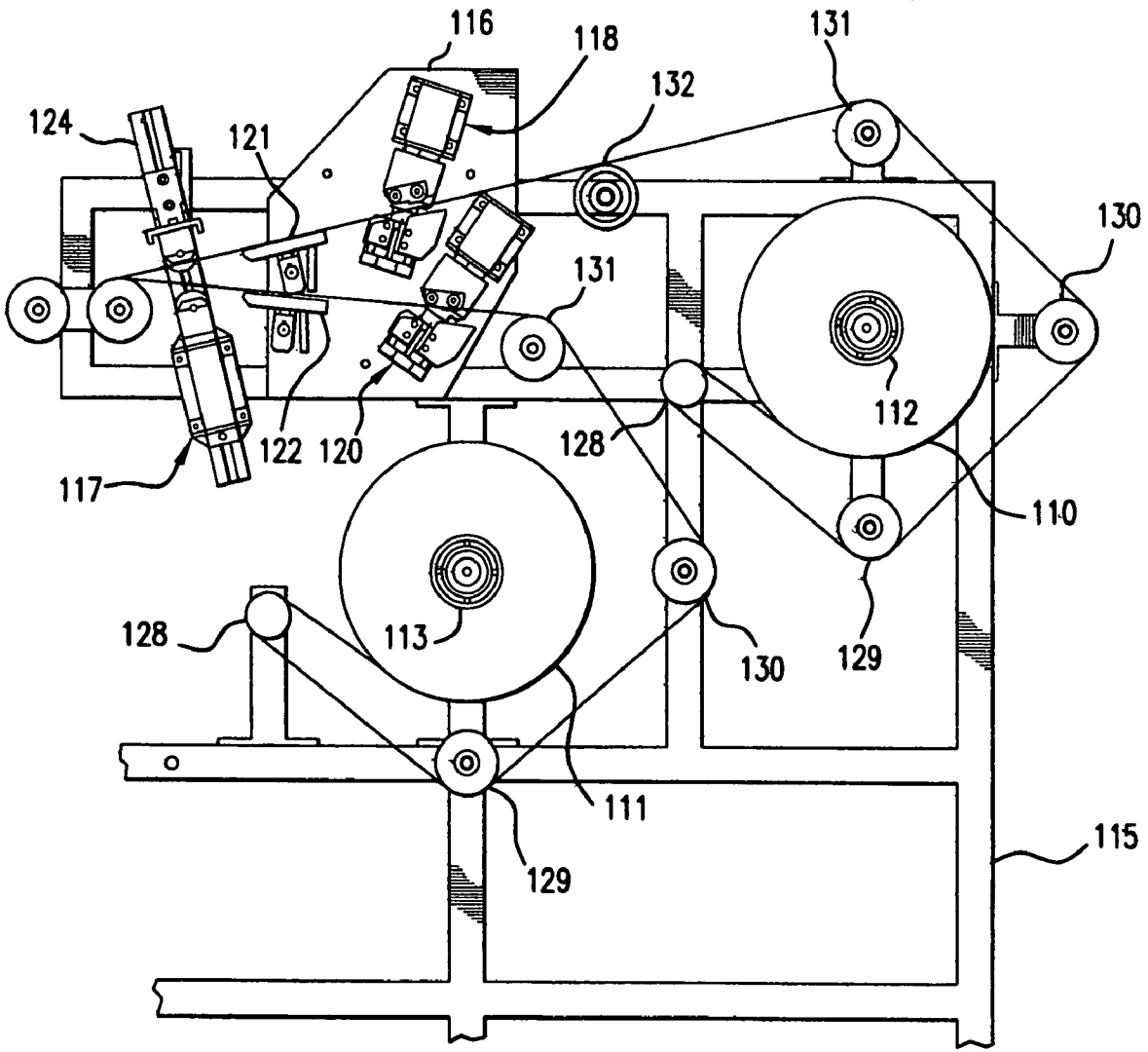
FIG. 9 is a front view of the splicing apparatus and the applicator.
Figure 10:
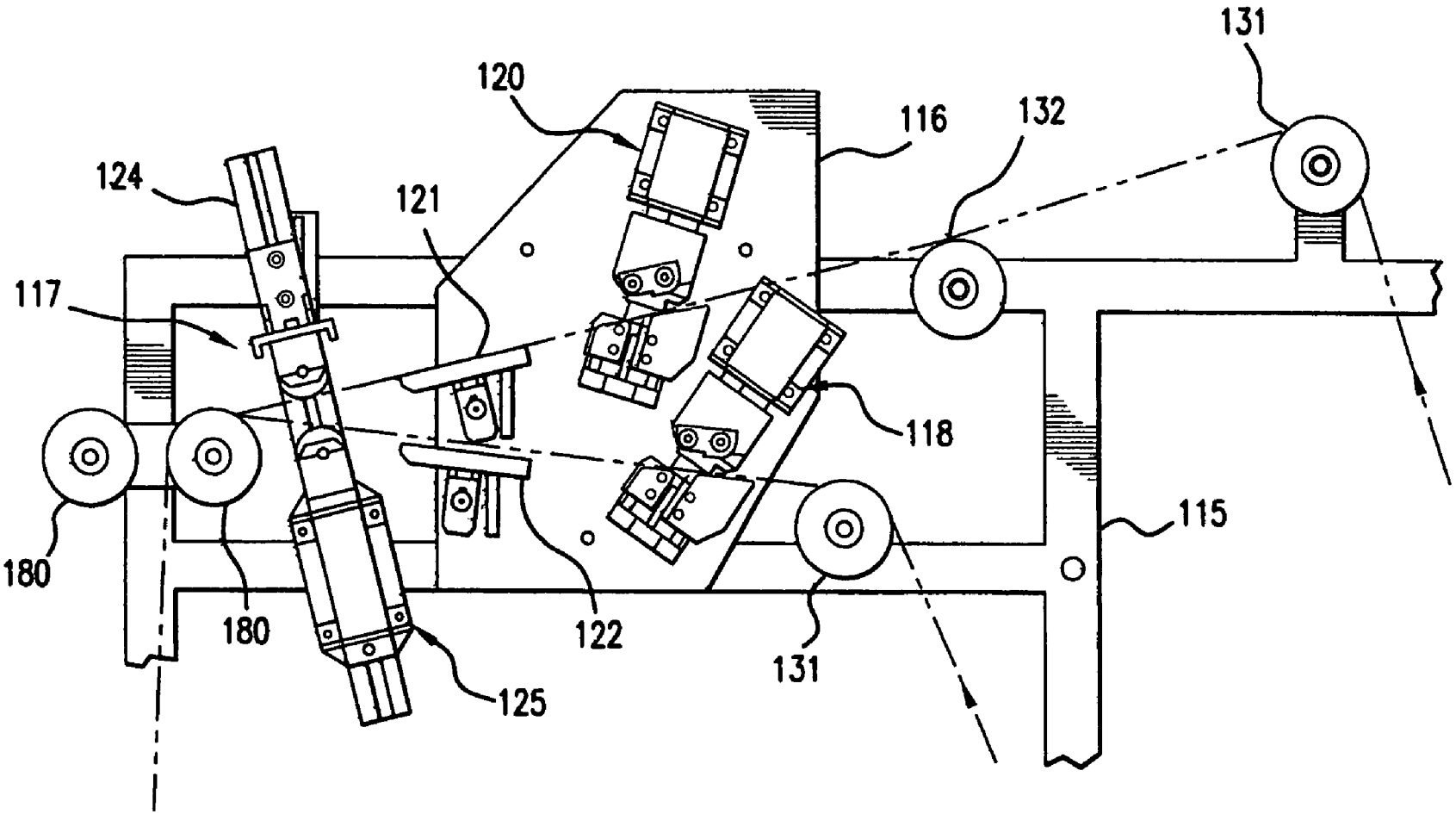
FIG. 10 is an elevational view of the splicing station of the apparatus shown in F*igure* 11.

The tape 11 is fed continuously to the feed roller 16 by an improved apparatus and method for providing continuous web material to an applicator machine. The tape is traversely wound on a core about six inches (15 cm) long to provide added tape length in a single roll. The supply rolls of material are illustrated in FIG. 9 of the drawing as 110 and 111. The supply rolls are supported on spindles 112 and 113 supported on a frame 115. Also, supported on the frame 115 is a support plate 116 upon which is mounted a pair of cutting knives 118 and 120 and a pair of staging plates 121 and 122 that are positioned to stage the free end of the second supply roll 111. The frame 115 also supports an extrusion forming a support bar 124 supporting a splicing station 117 including the nip rollers 160, 165 forming a splicing element 125.

Upstream from the cutting knives 118 and 120 are a plurality of advancing rolls which receive the tape from the supply roll 110 or 111. The series of advancing rollers form means for placing a reverse curl in the tape to destroy the memory in the convolutely and/or transversely wound tape on the roll core. The series of advancing rollers comprise a first cylindrical roller 128 having a length equal to that of the cylindrical core of the transversely wound tape with an axis parallel to the axis of the spindle. The tape is moved about 120 degrees to about 190 degrees around the surface of the roller 128 to initially break the memory in the tape backing. As the adhesive tape is unwound from the roll, 110 or 111, where it is wound with the adhesive side inward, the backing engages the rollers. The next pulley 129 has a concave surface with a fairly large radius, sometimes referred to as an "apple core pulley." Pulley 129 directs the tape toward a fixed straight line path. The third roller 130 is another concave pulley with a tighter radius, and brings the tape to the desired path, which is then defined by the fourth concave roller 131 of still smaller radius to the concave surface. As the tape leaves the roller 131, the memory in the tape is removed and the once wound tape is straightened and moves along a straight path. The tape 11 from the supply spindle 112 also moves over a further idler 132. From the roller or pulley 131, and idler 132, the tape is directed through the associated knife element 118. The tape is advanced around the pulleys with the adhesive surface disposed away from the surface of the pulleys. The memory in the tape varies with the construction of the tape. In some instances the amount of memory removal may vary, but it is desirable to have the tape straightened to extend from the staging area to the nip rollers.

Figure 11:
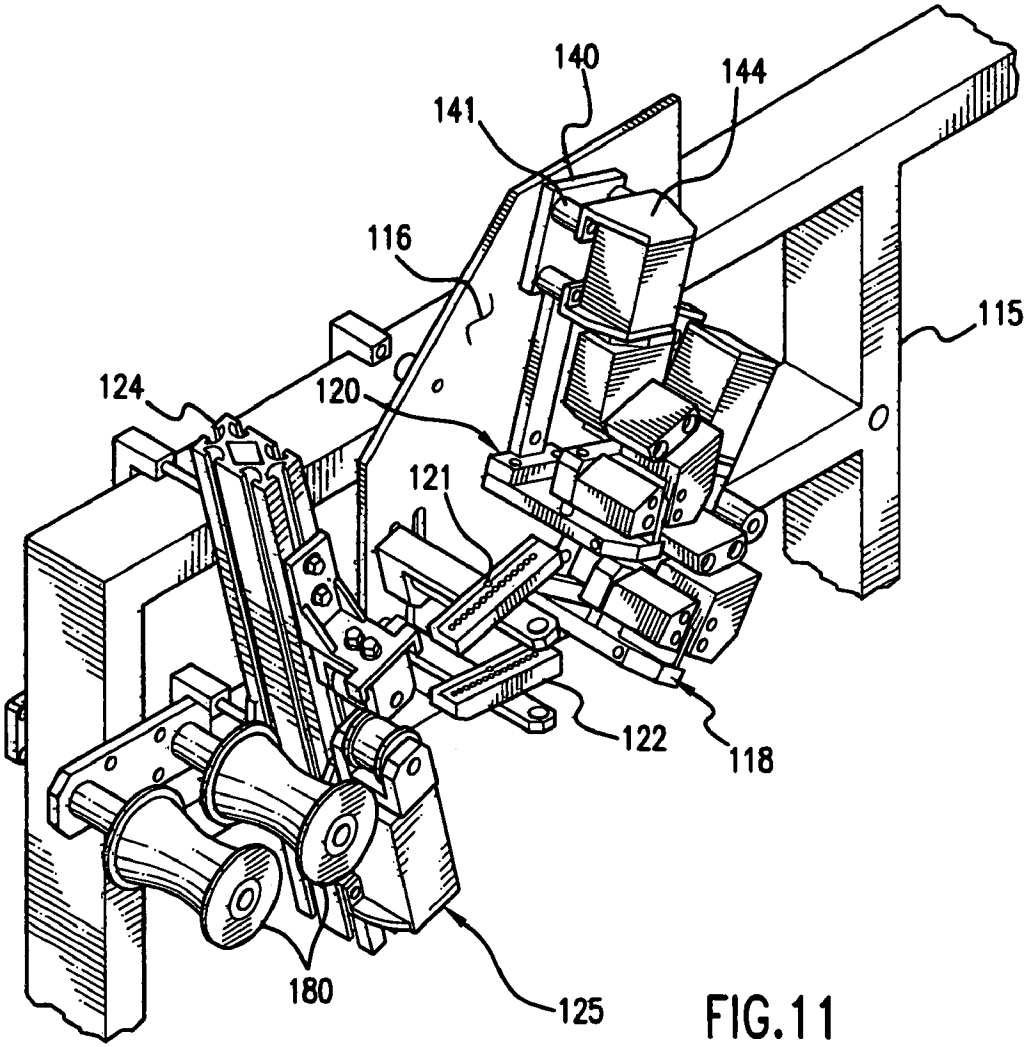
FIG. 11 is a fragmentary perspective view of the splicing station of the apparatus.
Figure 12:
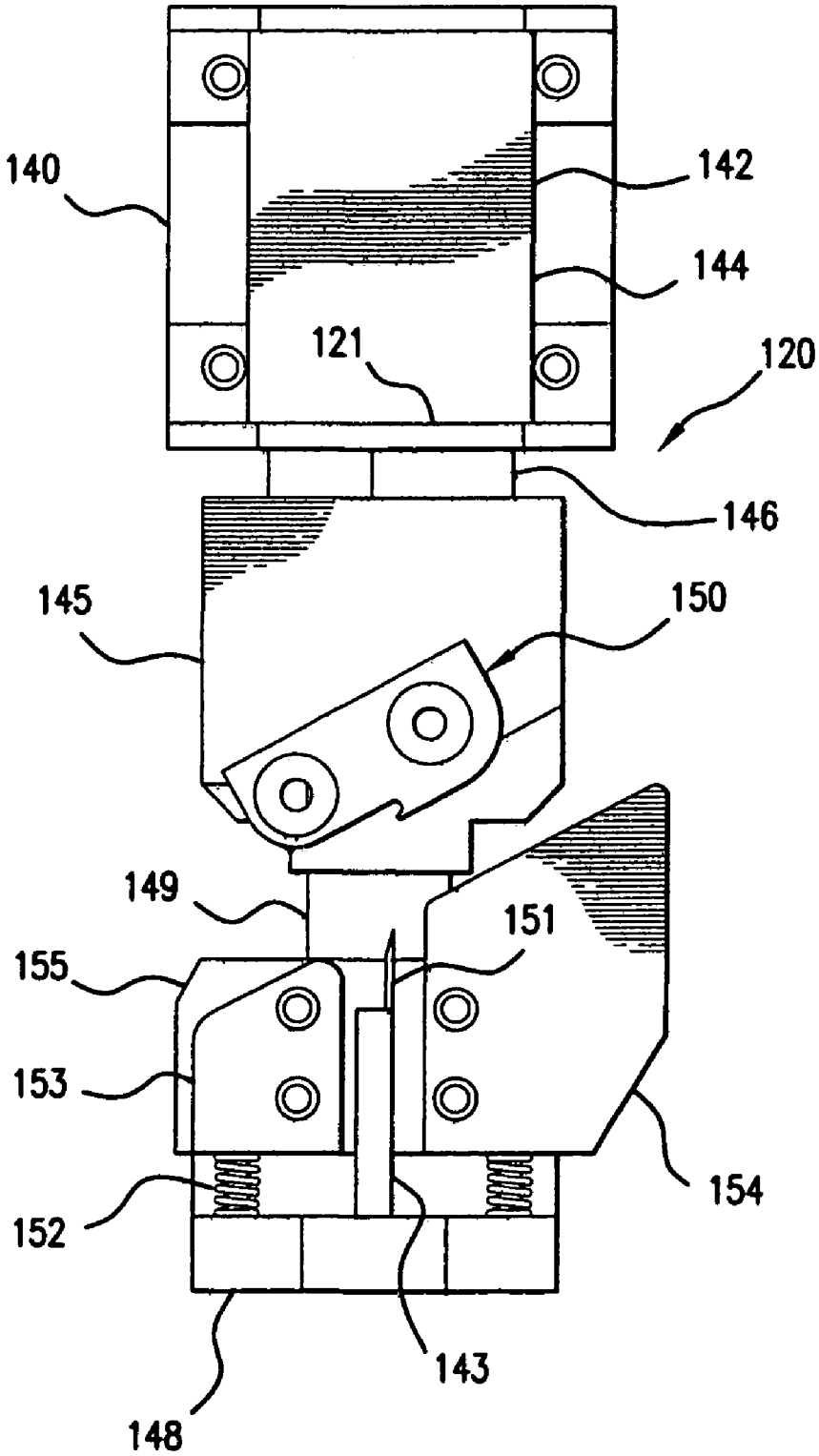
FIG. 12 is an elevational view of the cutting knife element of the apparatus.

A knife element is illustrated in FIG. 12, and is shown in perspective in FIG. 11. The knife element illustrated is identified by the reference numeral 120 and both knife elements are similar. A knife element includes a support plate 140, mounted on the support plate 116, which supports, on pins or posts 141, a motor 142. In the illustrated embodiment, the motor 142 is a pneumatic cylinder 144. The motor 142 drives a block 145, via a drive piston and adjustable nut 146, toward a fixed lower plate 148 attached by plate 149 to plate 140, with the block 145 attached. The block 145 carries an anvil 150, which comes into contact with a cutting blade comprising a fixed knife blade 151 projecting from a holder 143 mounted on a plate 148. The knife blade 151 is guarded by a pair of blocks 153, 154 positioned on opposite sides of the blade 151 to protect the operator threading the tape of the second supply roll through the knife element 118 or 120. The blocks 153, 154 are moved downward to expose the knife blade 151 as the anvil 150 forces the tape of the exhausted roll into the knife blade 151. The surfaces of the anvil 150 and blocks 153, 154 adjacent the tape path are coated with a release coat, such as a layer of silicone, either by using a strip of tape or coating the block, to prevent the adhesive on the tape from sticking to the surfaces. The upper surface of the block 154 is provided with a series of holes connected to a vacuum hose as will be described later. The surface of the block 154 holds the end or the cut supply web. The blocks 153, 154, on their slide block 155 are in line with the tape path, and are biased upward from the plate 148 to the position guarding the knife blade 151 by springs 152.

From the knife elements 118 and 120, described above, the second supply tape is placed on a surface such as a staging plate 121 or 122, and the staging plate is a plate with rails that form an open trough shaped member with a series of holes along its flat base communicating with vacuum line or a source of subatmospheric pressure. The vacuum lines are always open and operational. The staging surfaces are only active when the tape is inactive, i.e. awaiting the splicing step. When on the staging plate 122, a splicing tape is adhered to the free end of the second supply tape. The splicing tape is a length of pressure sensitive tape, comprising a film backing with a pressure sensitive adhesive coated on one surface, and is approximately 6 inches (15 cm) in length, with half of its length adhered to the tape backing and adjacent the free end of the standby tape and the other half extending beyond the free end of the standby tape and extending from the staging plate between the nip area of the splicing rollers of the splicing element 125. The staging plates 121, 122 are supported from the support plate 116 by brackets cantilevered from the plate with the hoses of the pneumatic system extending therefrom to the staging plates 121, 122.

In each of the splicing positions, i.e., with the second tape on a staging surface formed by, e.g. a plate 121 or 122, the adhesive surface of the splicing tape is directed inward of the two tapes. In this position the extended length of the splicing tape will engage the supply tape traveling over the other staging plate and when forced into contact at the nip of the splicing rollers the splice is made. When the second supply tape is staged on the plate 122, the splicing tape has the adhesive surface positioned for engagement with the adhesive layer on the supply tape. At the nip of the splicing rollers 160, 165 of the splicing element 125, the adhesive on the splicing tape engages the adhesive of the supply tape and makes the splice, and the knife element 118 simultaneously cuts the nearly exhausted supply tape.

Figure 13:
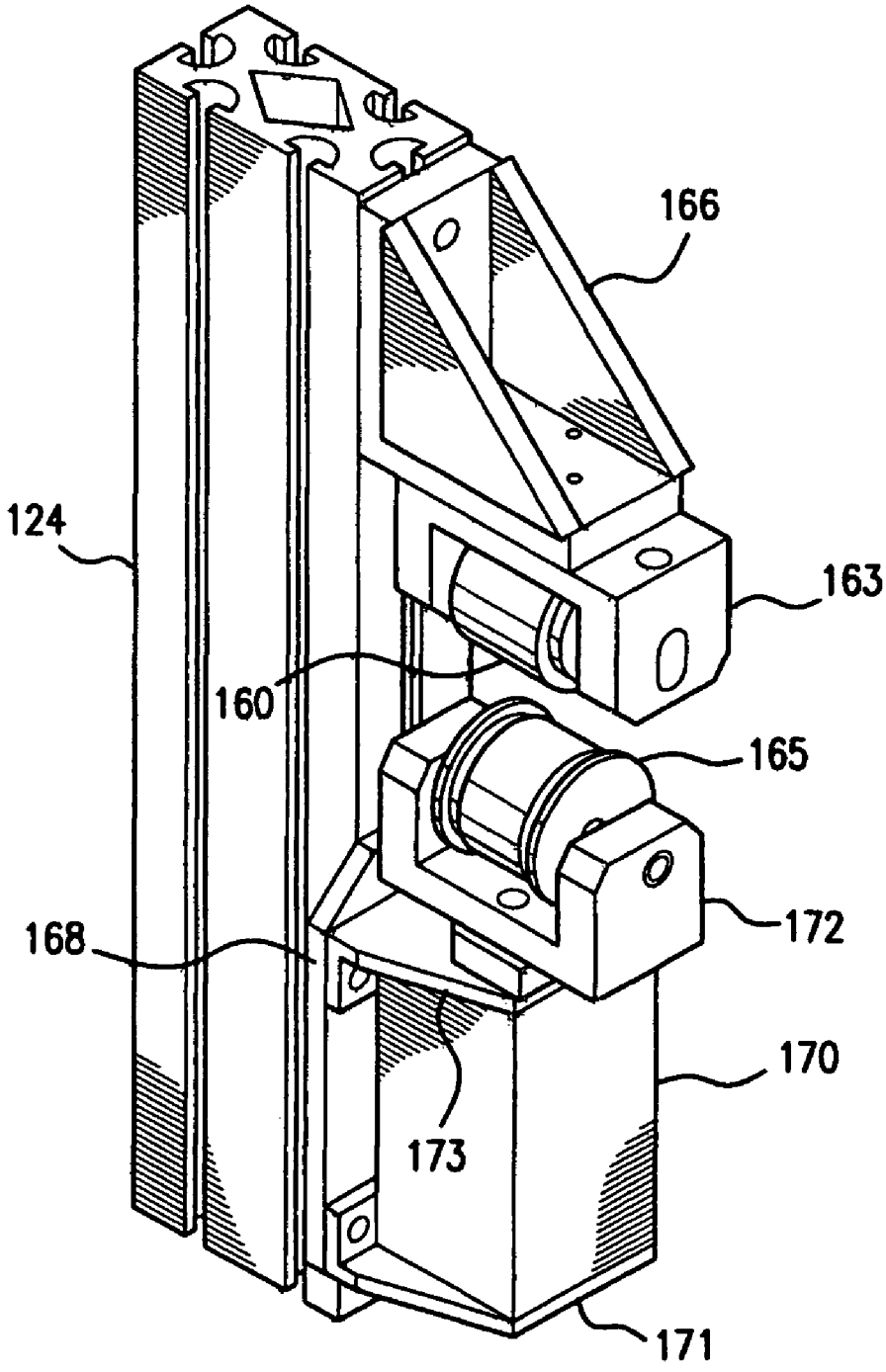
FIG. 13 is a perspective view of the splicing rollers of the apparatus.

The splicing area has the element 125, illustrated in FIG. 13. The splicing element 125 consists of at least a pair of rollers, e.g., 160, 165 normally positioned in spaced relationship. The upper roller 160, as illustrated, is supported in a U-shaped bracket 163 and has its trunnions or supporting axle positioned in slotted openings in the ends of the U-shaped bracket 163. Springs are provided to support the roller 160 such that it can move radially in relationship to the bracket 163 when making impact with the movable roller 165, such that the tape thickness does not damage or cause any deleterious effect on the splicing element. A gusset bracket 166 supports the U-shaped bracket 163 from the support bar 124, and affords adjustment of the roller position. The roller 160 has a release coat to restrict the adhesive from sticking to the roller 160.

The splicing element 125 further includes a movable pinch roller 165, reciprocatably driven by a motor means 170 sitting on a fixed mounting plate 171. The roller 165 is forced upward by the motor 170, which again is a pneumatic cylinder. The upward movement brings the rollers 165, 160 into engagement for a period sufficient to bring the splicing tape and the supply tape into intimate contact to make the splice. The rollers 165, 160 are then separated. Roller 165 is carried by a U-shaped bracket 172 supported for movement with the piston of the motor 170 above the plate 173 resting at the top of the motor 170. A support plate 168 attaches the motor 170 to the extrusion 124. The roller 165 has raised flanges at its ends to prevent the adhesive from squeezing out axially when the rollers 165, 160 are forced toward engagement.

The supply tape and the spliced tape leave the splicing area 125 and are directed over a first of a pair of "apple core pulleys" 180 and toward a feed roller. A tensioning pulley system can be added where the tape is festooned about pulleys that serve to maintain a given tension on the tape, before and immediately after the splicing, as it is advanced toward the feed roller from the splicing station 117. This festooning allows the tape to be slowed during splicing. 117. This festooning allows the tape to be slowed during splicing.

This splicing system is also very useful in splicing a web material referred to as a transfer tape. It comprises a web of paper coated on opposite sides with a release coating to allow the paper to be removed from the adhesive after the tape is applied to an article to be later sealed. The adhesive is a very tacky adhesive and is identified as a hot melt adhesive carried by a backing, e.g., a coated paper of polymeric film. The peel strength of the adhesive to the paper backing is such that the adhesive will not separate upon the splicing of the tapes to each other. The adhesive itself does not have a lot of internal strength and the splicing tape holds the tapes together during the initial splicing of the standby roll to the supply roll.

Figure 14:
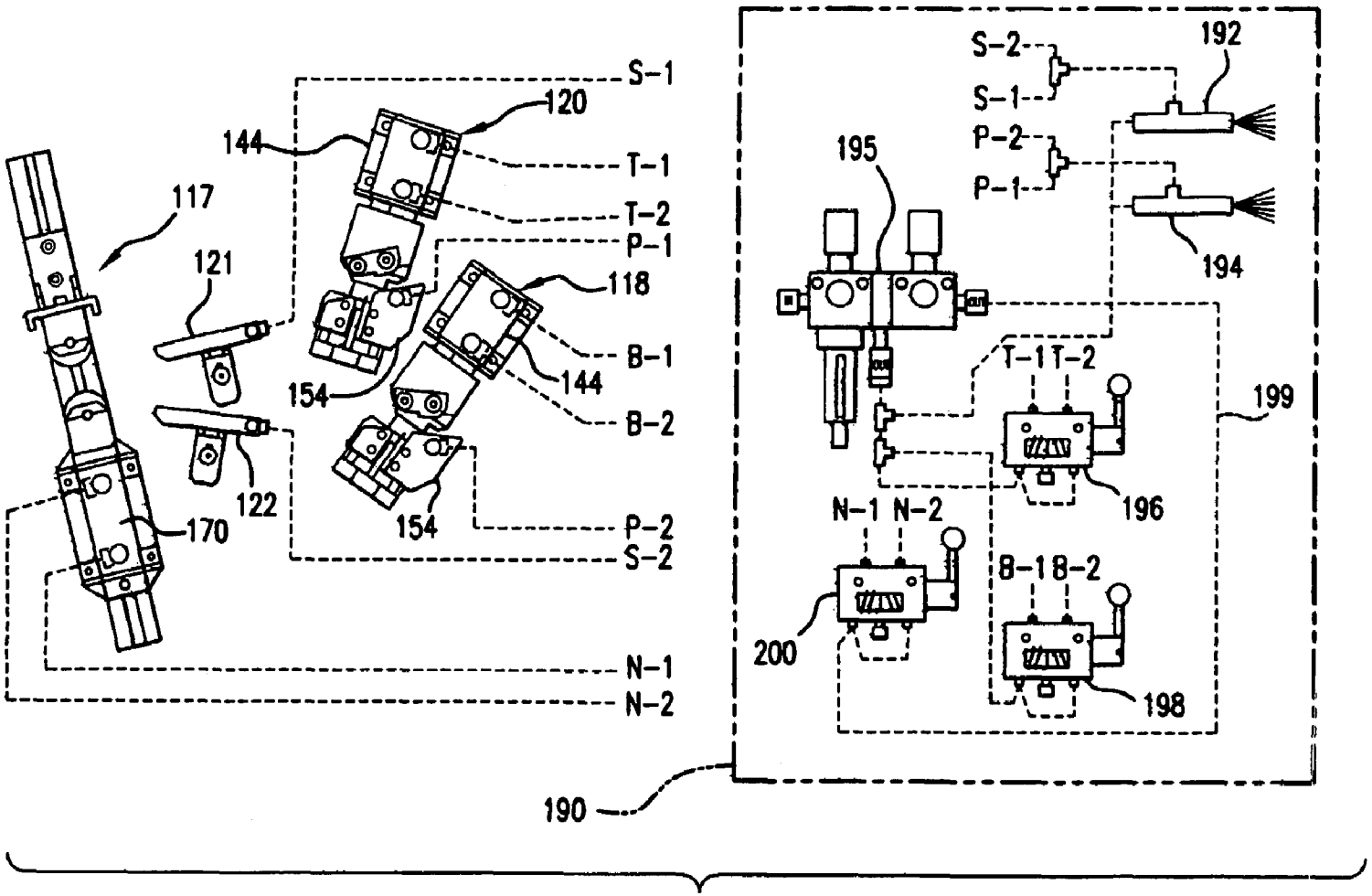
FIG. 14 is a detail view of the control panel for the pneumatically controlled elements of the splicing apparatus and how they are coupled.

FIG. 14 illustrates the control panel 190 and its association with the operating motors of the splicing system. The pneumatic pressure is provided to a pair of units 192 and 194, which are connected by hoses to exhaust air from the staging plates 120 and 122 and from the surfaces of the blocks 154 of the knives 118 and 120. Pressurized air is furnished to an accumulator 195 where it is directed to a first "T," which directs the air to units 192 and 194, and to a second "T," which directs the air to a control valve 196 to operate the motor 144 of the cutter 120 and to valve 198, which operates the motor 144 of cutter 120. Air of a lower pressure is directed via a line 199 to a valve 200 which operates the motor 170 at the splicing area 125. The outputs from the valves 196, 198, and 200 are connected to the lines as indicated by reference numerals T-1, T-2, B-1, B-2, N-1 and N-2. Pressurized air is directed by the valves into one end of the motors or into the other end as required to perform the operations indicated above. The pneumatic valves and the operation of the splicing unit can be controlled by the use of sensors on the tape to signal the approaching of the end of the supply tape and sequence the splicing of the standby tape to the supply tape as discussed above. The signaling can be directed to a PLC, which can interface with the pneumatic system to control the sequencing.

A second embodiment of the splicing mechanism to provide continuous lengths of tape to the applicator is illustrated in FIGS. 15 through 18. This second splicing apparatus utilizes the combination of supply roll spindles, means defining a tape path to remove the memory of the wound tape, a pressure sensitive splicing tape, staging areas for the second tape, cutting knives along the tape paths, and a splicing station for adhering the tapes together and directing the tape 11 to the applicator. As above, suitable pressure sensitive adhesives include, e.g., hot melt water-based, solvent based, and water-based pressure sensitive adhesives.

Figure 15:
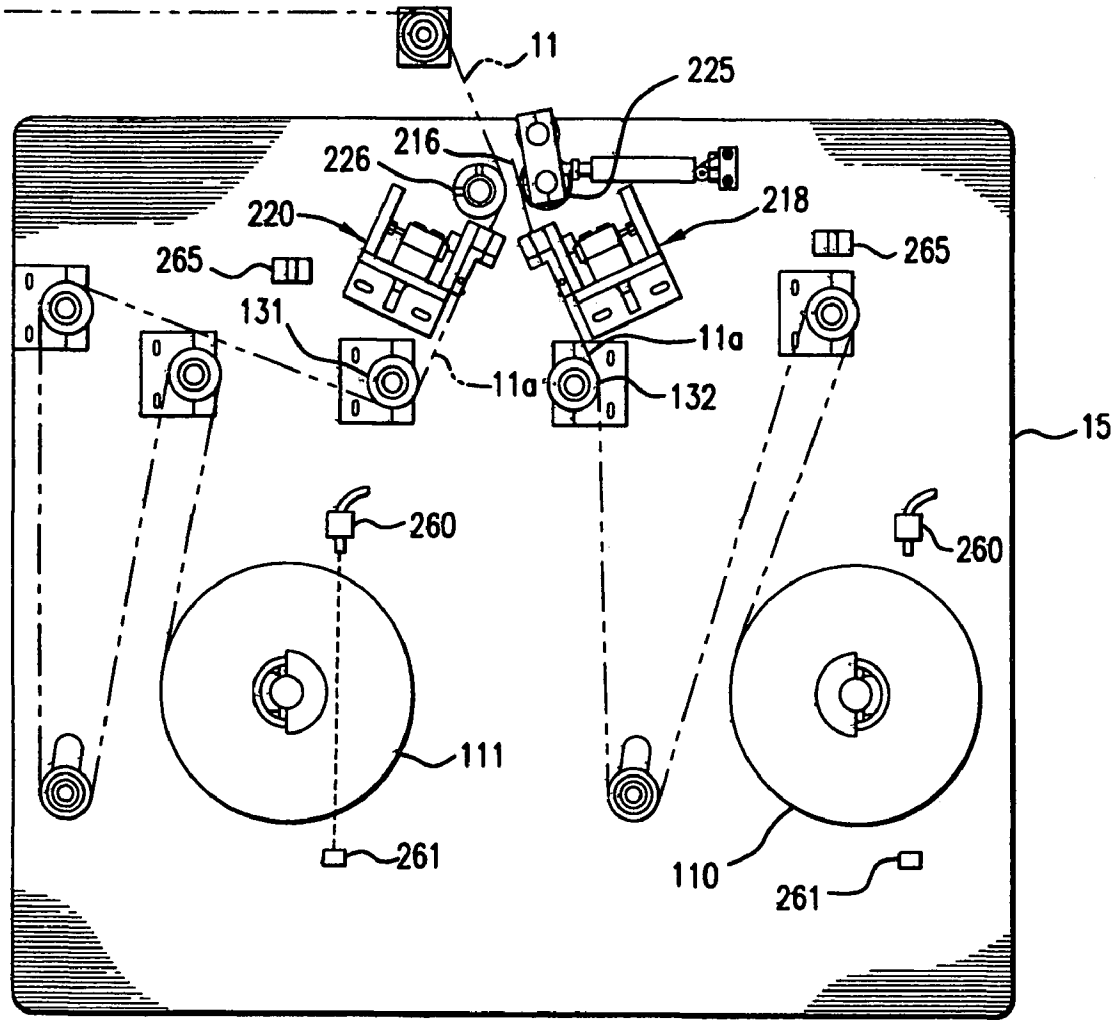
FIG. 15 is a diagrammatic elevational view of a second embodiment of the splicing apparatus.

The supply rolls of material are illustrated in FIG. 15 again as 110 and 111. The supply rolls are supported on spindles (not shown), supported by a frame (not shown) in the diagrammatic view in FIG. 15. The tape 11 is adhesively coated on the side 11*a*, interiorly of the rolls, with a hot melt adhesive as described above in the summary of the invention. From the rolls 110 and 111, the tape is guided by the last rollers 131 and 132, before being placed and travelling over the staging plates forming a part of the cutting knives in this embodiment. The staging plates are formed as a part of the tape cutting knives. The cutting knives are identified as 218 and 220. From the cutting knives the tapes are directed toward the pinch rollers in the splicing station 217, using a pair of nip rollers to form the splice between a splicing tape 216, which is a strip of tape that includes a backing and a coating of pressure sensitive adhesive. The splicing tape 216 is adhered to the leading end of the second tape along half the length of the splicing tape 216 with the remainder of the splicing tape 216 extending beyond the end of the second tape such that the pressure sensitive adhesive is directed inwardly of the two tapes to be bonded. The free end of the splicing tape 216 is prepositioned between the separated nip or pressure rollers 225 and 226 as shown in FIG. 15.

Figure 16:
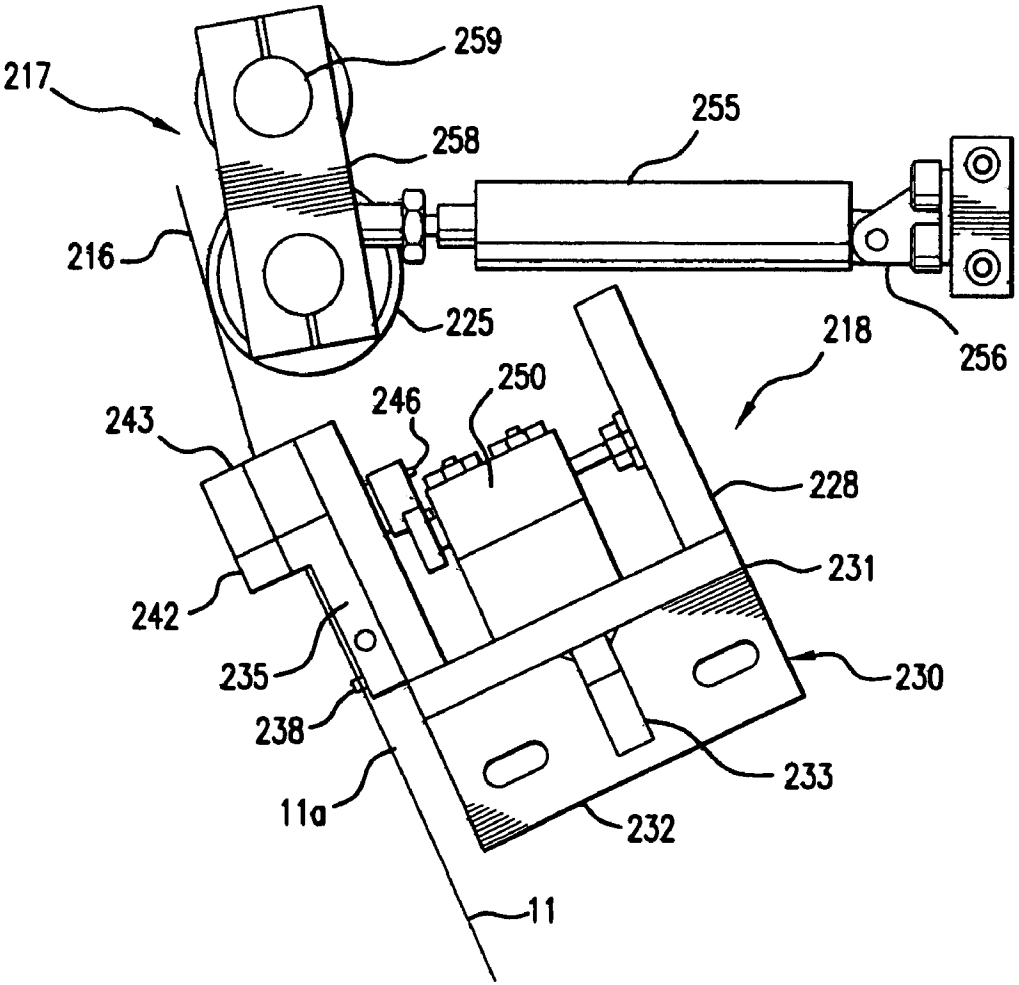
FIG. 16 is an enlarged detail view of a staging surface of the knife and of the pinch roller and actuator.
Figure 17:
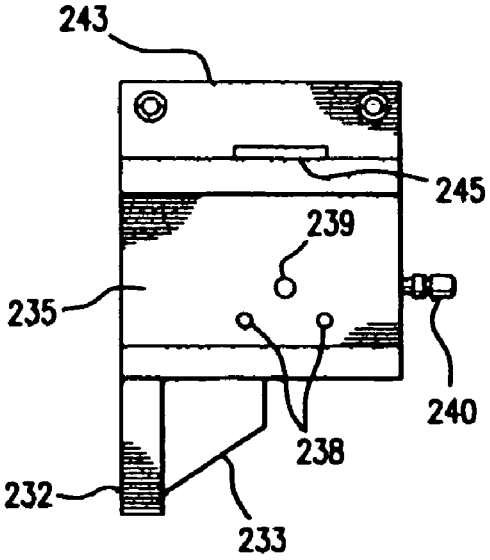
FIG. 17 is a side view of the cutting knife and staging surface showing the tape guide pins and vacuum area.
Figure 18:
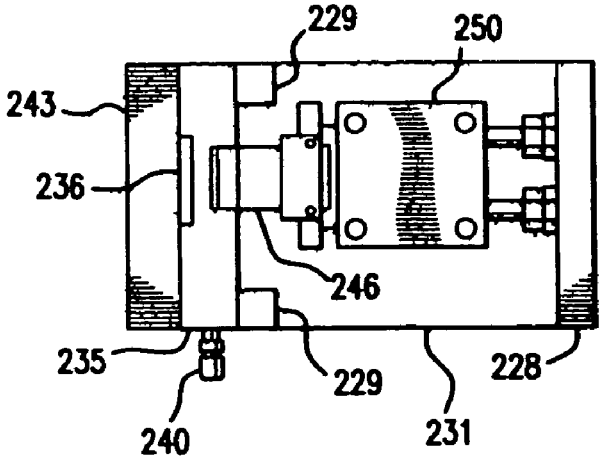
FIG. 18 is a top view of the cutting knife.
Figure 19:
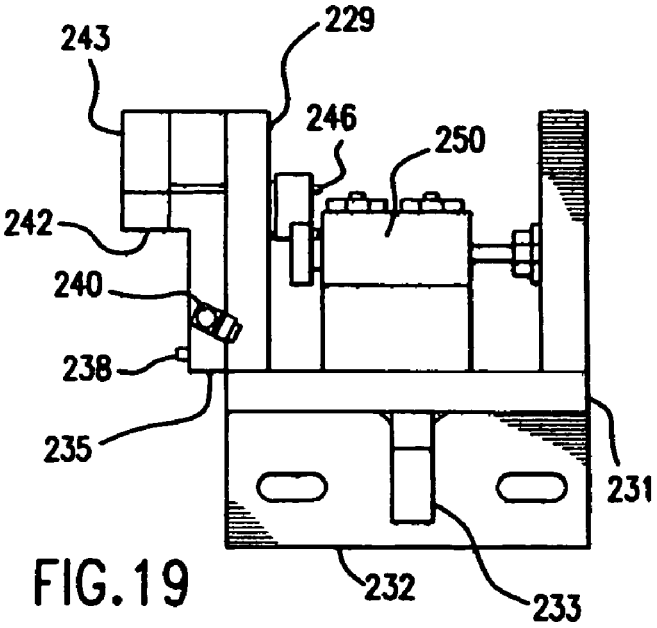
FIG. 19 is a front view of the cutting knife and staging member.

Referring to FIGS. 16 and 17, the cutting knife 218 is illustrated in detail, the knife 220 being similar, and comprises a bracket 230, formed by a support plate 231, an upright end plate 228 and two upright posts 229, a mounting plate 232 and a gusset plate 233 therebetween. Affixed on the legs 229 is an inverted L-shaped plate 235 forming the staging plate. The foot of the plate 235 has a cut out area 236, see FIG. 18, through which the tape path extends from the surface of plate 235, which plate is also formed with a pair of pins 238, between which the tape path is formed, and an opening 239 connected to a source of subatmospheric pressure to draw and hold the tape to the plate 235. The opening 239 is connected to the air source by a fitting 240. Positioned over the cut out 236 is a plate 242 and a bar 243. The bar 243 also has a narrow cut out 245, which is aligned with the tape path but transverse thereto such that a knife blade 246 can pass therethrough to cut the tape. Positioned above the foot of the plate 235 is a bar 244, joined to bar 243 and the posts 229, with cut out areas to continue the paths for the tape and the cutting blade 246. The cutter 218 has a pneumatic motor 250 to drive the piston to push the blade 246 across the tape path to cut the supply tape after a splice is made with the second supply tape and uses pneumatic pressure to retract the blade from the tape path.

The splice is completed by the nip or pressure roller 225 being forced toward the fixed roller 226 by a pneumatic motor 255, which is anchored at one end to the frame by a bracket 256. The other end of the motor 255 is pivotally connected to a frame supporting the roller 225. The frame 258 is pivoted about an axel 259 to swing the roller 225 against the roller 226 to force the splicing tape against the adhesive coated surface of the second tape. The supply tape is then cut by the cutting knife 220.

This embodiment also illustrates the use of a sensing device to send a signal to the programmable logic controller (PLC) to operate the splicing mechanism. The sensing device includes a sensing mechanism having a beam generating member 260 and a receiver 261 positioned adjacent to the spindles to signal the near depletion of the tape in each roll 110 and 111. Signals from these devices to the PLC aid in controlling the vacuum controls 265 for the motors 250 and 255 and other control mechanisms to provide the timely splicing of the successive rolls of tape.

Having described the invention with reference to accompanying illustrations of the apparatus of the present invention, it is contemplated that engineering changes can be made without departing from the spirit or scope of the invention as set forth in the appended claims.

Other embodiments are within the claims.

What is claimed is:

1. A method for continuously supplying tape to an applicator, comprising:

delivering a first tape to an applicator from a first spindle;

positioning a free end of a second tape in a first stationary guide adjacent a path of the first tape;

sensing the near exhaustion of the first tape;

connecting the free end of the second tape to the first tape at a first connection point downstream from the first stationary guide;

cutting the first tape at a first cutting point between the first connection point and the first spindle;

delivering the second tape to the applicator from a second spindle;

positioning a free end of a third tape in a second stationary guide adjacent a path of the second tape, wherein the second stationary guide is different than the first stationary guide;

sensing the near exhaustion of the second tape;

connecting the free end of the third tape to the second tape at a second connection point downstream from the second stationary guide; and cutting the second tape at a second cutting point between the second connection point and the second spindle.

2. The method of claim 1, wherein sensing the near exhaustion of the first tape comprises:

generating a beam such that the path of the beam is blocked by a roll of the first tape until the near exhaustion of the roll of the first tape; and receiving the beam at a receiver after the path of the beam becomes unobstructed by the near exhaustion of the roll of the first tape; and wherein the free end of the second tape is connected to the first tape upon receiving the beam at the receiver.

3. The method of claim 1, wherein positioning the free end of the second tape in the first stationary guide comprises:

holding the free end of the second tape in a fixed position.

4. The method of claim 3, wherein holding the free end of the second tape in a fixed position comprises applying subatmospheric pressure to a surface of the free end of the second tape.

5. The method of claim 1, wherein connecting the free end of the second tape to the first tape comprises:

attaching a length of splicing tape to the free end of the second tape such that a free end of the length of splicing tape extends between a pair of pinch rollers; and connecting an end portion of the length of splicing tape to the first tape by bringing the pair of pinch rollers together.

6. The method of claim 1, wherein the connecting of the free end of the second tape to the first tape and the cutting of the first tape at the first cutting point occur simultaneously.

7. The method of claim 1, wherein a sensing device senses the near exhaustion of the first tape and generates a signal to connect the free end of the second tape to the first tape and cut the first tape at the first cutting point.

8. A method for continuously supplying tape to an applicator, comprising:

delivering a first tape to an applicator from a first spindle;

positioning a free end of a second tape in a first guide adjacent a path of the first tape;

sensing the near exhaustion of the first tape;

connecting the free end of the second tape to the first tape at a first connection point;

cutting the first tape at a first cutting point between the first connection point and the first spindle;

delivering the second tape to the applicator from a second spindle;

positioning a free end of a third tape in a second guide adjacent a path of the second tape;

sensing the near exhaustion of the second tape;

connecting the free end of the third tape to the second tape at a second connection point; and cutting the second tape at a second cutting point between the second connection point and the second spindle wherein delivering the first tape to the applicator comprises:

rotating a feed roll to advance a first tape along a feed path;

picking up the first tape from the feed roll with a vacuum roll by applying subatmospheric pressure to a first surface of the first tape;

rotating the vacuum roll to advance the first tape along the feed path;

cutting the first tape on the vacuum roll with a rotary knife;

picking up a cut length of the first tape from the vacuum roll with a vacuum wheel applicator by applying subatmospheric pressure to a second surface of the first tape;

rotating the vacuum wheel applicator to apply the cut length of the first tape to a substrate.

9. The method of claim 1, wherein the tape comprises a hot melt adhesive tape, the method further comprises splicing successive rolls of the holt melt adhesive tape in end to end relationship and heating a section of the first tape, and the connecting of the free end of the second tape to the first tape comprises laminating the free end of the second tape with the first tape to splice the first tape and the second tape together.

10. The method of claim 9, wherein a sensing device senses the near exhaustion of the first tape and generates a signal to connect the free end of the second tape to the first tape and cut the first tape at the first cutting point.

11. The method of claim 5, wherein the length of splicing tape is a length of pressure sensitive adhesive tape.

12. The method of claim 1, wherein connecting the free end of the second tape to the first tape comprises connecting the free end of the second tape to the first tape with a length of pressure sensitive adhesive tape.

13. The method of claim 1, further comprising positioning a roll of the third tape on the first spindle after cutting the first tape at the first cutting point.

14. The method of claim 1, wherein the first tape is a transfer tape.

15. The method of claim 1, wherein the first tape is cut by a first knife element, the second tape is cut by a second knife element, and the first knife element is different than the second knife element.

16. The method of claim 1, wherein delivering the first tape to the applicator comprises passing the first tape around a series of rollers to place a reverse curl in the first tape.

17. The method of claim 1, further comprising festooning the first tape to control the tension of the first tape.

18. The method of claim 8, wherein the vacuum wheel applicator is rotated at a peripheral speed matched to a line speed of the substrate, and further comprising controlling the peripheral speeds of the feed roll and/or the vacuum roll relative to the peripheral speed of the vacuum wheel applicator to control a length and/or a placement of the cut length of the first tape.

19. The method of claim 8, further comprising detecting a position of a leading edge of the substrate or a printed indicia on the substrate and inputting the position into a controller, wherein the controller uses the position to modify the peripheral speed of the vacuum roll so as to control a length and/or a placement of the cut length of the first tape.

20. The method of claim 8, further comprising heating the cut length of the first tape before applying the cut length of the first tape to the substrate.

* * * * *